US007094524B2

(12) United States Patent
Kong et al.

(10) Patent No.: US 7,094,524 B2
(45) Date of Patent: Aug. 22, 2006

(54) THERMALLY DEVELOPMENT IMAGING MATERIALS HAVING BACKSIDE STABILIZERS

(75) Inventors: Steven H. Kong, Woodbury, MN (US); Kumars Sakizadeh, Woodbury, MN (US); William D. Ramsden, Afton, MN (US)

(73) Assignee: Eastman Kodak Company, Rochester, NY (US)

( * ) Notice: Subject to any disclaimer, the term of this patent is extended or adjusted under 35 U.S.C. 154(b) by 80 days.

(21) Appl. No.: 10/686,280

(22) Filed: Oct. 15, 2003

(65) Prior Publication Data

US 2005/0084809 A1 Apr. 21, 2005

(51) Int. Cl.
*G03C 1/76* (2006.01)
*G03C 1/498* (2006.01)

(52) U.S. Cl. ..... 430/523; 430/510; 430/512; 430/607; 430/613; 430/614; 430/619; 430/623; 430/961

(58) Field of Classification Search ..... 430/523, 430/619, 620, 350, 607, 613, 614, 961, 510, 430/512, 623
See application file for complete search history.

(56) References Cited

U.S. PATENT DOCUMENTS 4,212,937 A * 7/1980 Akashi et al. ..... 430/620
6,063,560 A 5/2000 Suzuki et al.
6,465,162 B1 10/2002 Kong et al.
6,599,685 B1 7/2003 Kong

FOREIGN PATENT DOCUMENTS

| | | | |
|---|---|---|---|
| EP | 0 708 086 A1 | | 4/1996 |
| EP | 1096310 | * | 6/2001 |
| EP | 1186950 A1 | * | 3/2002 |
| JP | 2002-328446 | | 11/2002 |
| JP | 2003-21883 | | 1/2003 |

OTHER PUBLICATIONS

K. Sakizadeh, *Journal of Imaging Sci. Technol.*, 2003, 47(3), pp. 263-277.

* cited by examiner

*Primary Examiner*—Thorl Chea
(74) *Attorney, Agent, or Firm*—James L. Tucker; Louis M. Leichter

(57) ABSTRACT

Thermally developable photothermographic materials comprise a backside layer that includes a backside stabilizer to reduce fog formation in high humidity conditions, thereby providing improved shelf stability. Useful backside stabilizers include an amine organic base whose conjugate acid has a pKa greater than 5. These backside stabilizers can be provided particularly in non-photosensitive compositions that include an antihalation composition.

21 Claims, No Drawings

THERMALLY DEVELOPMENT IMAGING MATERIALS HAVING BACKSIDE STABILIZERS

FIELD OF THE INVENTION

This invention relates to thermally developable imaging materials such as photothermographic materials. More particularly, it relates to photothermographic imaging materials that have improved shelf stability under high humidity conditions. The invention also relates to methods of imaging using these materials. In addition, this invention relates to unique backside compositions that also provide stabilization of photothermographic materials.

BACKGROUND OF THE INVENTION

Silver-containing photothermographic imaging materials that are developed with heat and without liquid development have been known in the art for many years. Such materials are used in a recording process wherein an image is formed by imagewise exposure of the photothermographic material to specific electromagnetic radiation (for example, visible, ultraviolet, or infrared radiation) and developed by the use of thermal energy. These materials, also known as "dry silver" materials, generally comprise a support having coated thereon: (a) a photosensitive catalyst (such as silver halide) that upon such exposure provides a latent image in exposed grains that are capable of acting as a catalyst for the subsequent formation of a silver image in a development step, (b) a non-photosensitive source of reducible silver ions, (c) a reducing composition (usually including a developer) for the reducible silver ions, and (d) a hydrophilic or hydrophobic binder. The latent image is then developed by application of thermal energy.

In such materials, the photosensitive catalyst is generally a photographic type photosensitive silver halide that is considered to be in catalytic proximity to the non-photosensitive source of reducible silver ions. Catalytic proximity requires intimate physical association of these two components either prior to or during the thermal image development process so that when silver atoms $(Ag^0)_n$, also known as silver specks, clusters, nuclei or latent image, are generated by irradiation or light exposure of the photosensitive silver halide, those silver atoms are able to catalyze the reduction of the reducible silver ions within a catalytic sphere of influence around the silver atoms [D. H. Klosterboer, *Imaging Processes and Materials*, (*Neblette's Eighth Edition*), J. Sturge, V. Walworth, and A. Shepp, Eds., Van Nostrand-Reinhold, New York, 1989, Chapter 9, pp. 279–291]. It has long been understood that silver atoms act as a catalyst for the reduction of silver ions, and that the photosensitive silver halide can be placed in catalytic proximity with the non-photosensitive source of reducible silver ions in a number of different ways (see, for example, *Research Disclosure*, June 1978, item 17029). Other photosensitive materials, such as titanium dioxide, cadmium sulfide, and zinc oxide have also been reported to be useful in place of silver halide as the photocatalyst in photothermographic materials [see for example, Shepard, *J. Appl. Photog. Eng.* 1982, 8(5), 210–212, Shigeo et al., *Nippon Kagaku Kaishi,* 1994, 11, 992–997, and FR 2,254,047 (Robillard)].

The photosensitive silver halide may be made "in-situ," for example by mixing an organic or inorganic halide-containing source with a source of reducible silver ions to achieve partial metathesis and thus causing the in-situ formation of silver halide (AgX) grains throughout the silver source [see, for example, U.S. Pat. No. 3,457,075 (Morgan et al.)]. In addition, photosensitive silver halides and sources of reducible silver ions can be coprecipitated [see Yu. E. Usanov et al., *J. Imag. Sci. Tech.* 1996, 40, 104]. Alternatively, a portion of the reducible silver ions can be completely converted to silver halide, and that portion can be added back to the source of reducible silver ions (see Yu. E. Usanov et al., International Conference on Imaging Science, Sep. 7–11, 1998).

The silver halide may also be "preformed" and prepared by an "ex-situ" process whereby the silver halide (AgX) grains are prepared and grown separately. With this technique, one has the possibility of controlling the grain size, grain size distribution, dopant levels, and composition much more precisely, so that one can impart more specific properties to both the silver halide grains and the photothermographic material. The preformed silver halide grains may be introduced prior to and be present during the formation of the source of reducible silver ions. Co-precipitation of the silver halide and the source of reducible silver ions provides a more intimate mixture of the two materials [see for example U.S. Pat. No. 3,839,049 (Simons)]. Alternatively, the preformed silver halide grains may be added to and physically mixed with the source of reducible silver ions.

The non-photosensitive source of reducible silver ions is a material that contains reducible silver ions. Typically, the preferred non-photosensitive source of reducible silver ions is a silver salt of a long chain aliphatic carboxylic acid having from 10 to 30 carbon atoms, or mixtures of such salts. Such acids are also known as "fatty acids" or "fatty carboxylic acids." Silver salts of other organic acids or other organic compounds, such as silver imidazoles, silver tetrazoles, silver benzotriazoles, silver benzotetrazoles, silver benzothiazoles and silver acetylides have also been proposed. U.S. Pat. No. 4,260,677 (Winslow et al.) discloses the use of complexes of various inorganic or organic silver salts.

In photothermographic materials, exposure of the photographic silver halide to light produces small clusters containing silver atoms $(Ag^0)_n$. The imagewise distribution of these clusters, known in the art as a latent image, is generally not visible by ordinary means. Thus, the photosensitive material must be further developed to produce a visible image. This is accomplished by the reduction of silver ions that are in catalytic proximity to silver halide grains bearing the silver-containing clusters of the latent image. This produces a black-and-white image. The non-photosensitive silver source is catalytically reduced to form the visible black-and-white negative image while much of the silver halide, generally, remains as silver halide and is not reduced.

In photothermographic materials, the reducing agent for the reducible silver ions, often referred to as a "developer," may be any compound that, in the presence of the latent image, can reduce silver ion to metallic silver and is preferably of relatively low activity until it is heated to a temperature sufficient to cause the reaction. A wide variety of classes of compounds have been disclosed in the literature that function as developers for photothermographic materials. At elevated temperatures, the reducible silver ions are reduced by the reducing agent. In photothermographic materials, upon heating, this reaction occurs preferentially in the regions surrounding the latent image. This reaction produces a negative image of metallic silver having a color that ranges from yellow to deep black depending upon the presence of toning agents and other components in the imaging layer(s).

Differences Between Photothermography and Photography

The imaging arts have long recognized that the field of photothermography is clearly distinct from that of photography. Photothermographic materials differ significantly from conventional silver halide photographic materials that require processing with aqueous processing solutions.

As noted above, in photothermographic imaging materials, a visible image is created by heat as a result of the reaction of a developer incorporated within the material. Heating at 50° C. or more is essential for this dry development. In contrast, conventional photographic imaging materials require processing in aqueous processing baths at more moderate temperatures (from 30° C. to 50° C.) to provide a visible image.

In photothermographic materials, only a small amount of silver halide is used to capture light and a non-photosensitive source of reducible silver ions (for example a silver carboxylate) is used to generate the visible image using thermal development. Thus, the imaged photosensitive silver halide serves as a catalyst for the physical development process involving the non-photosensitive source of reducible silver ions and the incorporated reducing agent. In contrast, conventional wet-processed, black-and-white photographic materials use only one form of silver (that is, silver halide) that, upon chemical development, is itself converted into the silver image, or that upon physical development requires addition of an external silver source (or other reducible metal ions that form black images upon reduction to the corresponding metal). Thus, photothermographic materials require an amount of silver halide per unit area that is only a fraction of that used in conventional wet-processed photographic materials.

In photothermographic materials, all of the "chemistry" for imaging is incorporated within the material itself. For example, such materials include a developer (that is, a reducing agent for the reducible silver ions) while conventional photographic materials usually do not. Even in so-called "instant photography," the developer chemistry is physically separated from the photosensitive silver halide until development is desired. The incorporation of the developer into photothermographic materials can lead to increased formation of various types of "fog" or other undesirable sensitometric side effects. Therefore, much effort has gone into the preparation and manufacture of photothermographic materials to minimize these problems during the preparation of the photothermographic emulsion as well as during coating, use, storage, and post-processing handling.

Moreover, in photothermographic materials, the unexposed silver halide generally remains intact after development and the material must be stabilized against further imaging and development. In contrast, silver halide is removed from conventional photographic materials after solution development to prevent further imaging (that is in the aqueous fixing step).

In photothermographic materials, the binder is capable of wide variation and a number of binders (both hydrophilic and hydrophobic) are useful. In contrast, conventional photographic materials are limited almost exclusively to hydrophilic colloidal binders such as gelatin.

Because photothermographic materials require dry thermal processing, they present distinctly different problems and require different materials in manufacture and use, compared to conventional, wet-processed silver halide photographic materials. Additives that have one effect in conventional silver halide photographic materials may behave quite differently when incorporated in photothermographic materials where the underlying chemistry is significantly more complex. The incorporation of such additives as, for example, stabilizers, antifoggants, speed enhancers, supersensitizers, and spectral and chemical sensitizers in conventional photographic materials is not predictive of whether such additives will prove beneficial or detrimental in photothermographic materials. For example, it is not uncommon for a photographic antifoggant useful in conventional photographic materials to cause various types of fog when incorporated into photothermographic materials, or for supersensitizers that are effective in photographic materials to be inactive in photothermographic materials.

These and other distinctions between photothermographic and photographic materials are described in *Imaging Processes and Materials* (*Neblette's Eighth Edition*), noted above, *Unconventional Imaging Processes*, E. Brinckman et al. (Eds.), The Focal Press, London and New York, 1978, pp. 74–75, in C. Zou et al., *J. Imaging Sci. Technol.* 1996, 40, pp. 94–103, and in M. R. V. Sahyun, *J. Imaging Sci. Technol.* 1998, 42, 23.

Problem to be Solved

The ability of a photothermographic material to be stored without undergoing changes in sensitometric or physical properties is often referred to as "raw-stock keeping" (RSK) or "shelf stability." One aspect of improving raw-stock keeping is the control of fog. Photothermographic emulsions, in a manner similar to photographic emulsions and other light-sensitive systems, tend to suffer from fog. Fog is spurious image density that appears in non-imaged areas of the photothermographic material after development and is often reported in sensitometric results as $D_{min}$. In efforts to make more sensitive photothermographic elements, a difficult parameter to control and to maintain at a very low level is fog or $D_{min}$, especially under conditions of high humidity.

As described above, photothermographic materials contain both the image-forming chemistry and the development chemistry in one or more thermally developable imaging layers. During storage and prior to use, the image-forming and development chemistry may degrade or may prematurely chemically react especially in high humidity and temperature conditions. Later, upon imaging and development, this reaction will be observed as an increase in $D_{min}$ in the non-imaged areas. This reaction shortens the shelf-life of photothermographic materials and is often referred to as "shelf-aging fog." A great amount of work has been done to improve the shelf-life characteristics of photothermographic materials.

Most of the efforts to promote shelf stability have involved adding stabilizers to the imaging side of the photothermographic materials as described for example in K. Sakizadeh, *Journal of Imaging Sci. Technol.,* 2003, 47(3), 263–277, and references cited therein.

Backside stabilizers are described in U.S. Pat. No. 6,599,685 (Kong). These compounds include pyridazines, phthalazines, phthalazinones, benzoxazinediones, benzthiazines, and quinazoline diones. While these compounds are effective for their intended purpose of improving shelf stability, there is continuing research in the industry to find compounds that provide shelf life stability prior to imaging and heat development.

SUMMARY OF THE INVENTION

The present invention provides a photothermographic material that comprises a support having on an imaging side thereof, one or more thermally-developable imaging layers comprising a binder and in reactive association, a photosensitive silver halide, a non-photosensitive source of reducible silver ions, and a reducing composition for the non-photosensitive source reducible silver ions, and on the opposing backside of the support, a backside layer comprising a binder and an amine organic base as a backside stabilizer, the conjugate acid of the organic base having a pKa greater than 5 and being present in an amount of at least 0.01 mmol/$m^2$.

In preferred embodiments, the present invention provides a photothermographic material that comprises a transparent polymer support having on an imaging side thereof:

a) one or more thermally-developable imaging layers comprising a hydrophobic binder and in reactive association:
   - a photosensitive silver bromide, silver iodobromide, or a mixture thereof,
   - a non-photosensitive source of reducible silver ions that comprises one or more silver carboxylates at least one of which is silver behenate,
   - a reducing composition for the non-photosensitive source reducible silver ions, and b) on the backside of the support, an antihalation layer comprising an antihalation composition, an antistatic material, and a backside stabilizer that is present in an amount of from about 0.05 to about 2 mmol/$m^2$ and is one or more of the compounds (AB-1) to (AB-24) described below.

A method of forming a visible image of this invention comprises:

A) imagewise exposing the photothermographic material of the present invention to electromagnetic radiation to form a latent image, B) simultaneously or sequentially, heating the exposed photothermographic material to develop the latent image into a visible image.

In embodiments of this method wherein the photothermographic material comprises a transparent support, the image-forming method further comprises:

C) positioning the exposed and heat-developed photothermographic material with a visible image therein, between a source of imaging radiation and an imageable material that is sensitive to the imaging radiation, and D) thereafter exposing the imageable material to the imaging radiation through the visible image in the exposed and heat-developed photothermographic material to provide a visible image in the imageable material.

This invention also provides a non-photosensitive composition comprising an antihalation composition, a binder, and an amine or organic base whose conjugate acid has a pKa greater than 5 and preferably a 25° C. vapor pressure of less than 8 torr, or a mixture of two or more of these compounds, the backside stabilizer being present in the amount of from about 0.01 to about 10% (composition by weight).

When the photothermographic materials of this invention are heat-developed as described below in a substantially water-free condition after, or simultaneously with, imagewise exposure, a silver image (preferably a black-and-white silver image) is obtained. The photothermographic material may be exposed in step A using any source of radiation to which they are sensitive, including X-radiation, ultraviolet light, visible light, near infrared radiation, infrared radiation, or any other radiation source readily apparent to one skilled in the art. One particularly preferred form of useful radiation is infrared radiation generated by an infrared laser, an infrared laser diode, an infrared light-emitting diode, an infrared lamp, or any other infrared radiation source readily apparent to one skilled in the art. The resulting images are particularly useful for medical diagnosis.

The photothermographic materials of this invention are stabilized for longer storage by using specific organic amines in one or more backside layers. The materials are generally stored in stacks so that the backside of one material (or film) is in contact with another material (or film) underneath it. Thus, the backside layers containing the organic amines are generally in contact with the frontside imaging layers of the underlying film. In this arrangement, stabilization of the various stacked photothermographic materials can be achieved.

Thus this invention also provides a photographic film pack or stack comprising a plurality of photothermographic materials, each photothermographic material comprising a support having, on a frontside imaging side thereof, one or more thermally-developable imaging layers comprising a binder and in reactive association, a photosensitive silver halide, a non-photosensitive source of reducible silver ions, and a reducing composition for said non-photosensitive source reducible silver ions, and on the opposing backside of said support, a backside layer comprising a binder and an amine organic base as a backside stabilizer, the conjugate acid of said organic base having a pKa greater than 5 and being present in an amount of at least 0.01 mmol/$m^2$.

The frontside imaging layer of one photothermographic material being in contact with the backside layer of an adjacent photothermographic material.

This photothermographic film pack or stack can be contained in a suitable container for storage, transport or use.

DETAILED DESCRIPTION OF THE INVENTION

The photothermographic materials of this invention can be used, for example, in conventional black-and-white or color photothermography and in electronically generated black-and-white or color hardcopy recording. They can be used in microfilm applications, in radiographic imaging (for example digital medical imaging), X-ray radiography, and in industrial radiography. Furthermore, the absorbance of these photothermographic materials between 350 and 450 nm is desirably low (less than 0.5), to permit their use in the graphic arts area (for example, imagesetting and phototypesetting), in the manufacture of printing plates, in contact printing, in duplicating ("duping"), and in proofing.

The photothermographic materials of this invention are particularly useful for medical imaging of human or animal subjects to provide black-and-white images.

The photothermographic materials of this invention can be made sensitive to radiation of any suitable wavelength. Thus, in some embodiments, the materials are sensitive at ultraviolet, visible, infrared, or near infrared wavelengths, of the electromagnetic spectrum. Increased sensitivity to a particular region of the spectrum is imparted through the use of various sensitizing dyes. In other embodiments, they are sensitive to X-radiation. Increased sensitivity to X-radiation is imparted through the use of phosphors.

The photothermographic materials of this invention are also useful for non-medical uses of visible or X-radiation (such as X-ray lithography and industrial radiography).

In the photothermographic materials of this invention, the components needed for imaging can be in one or more layers. The layer(s) that contain the photosensitive photocatalyst (such as a photosensitive silver halide) or the non-photosensitive source of reducible silver ions, or both, are referred to herein as photothermographic emulsion layer(s). The photocatalyst and the non-photosensitive source of reducible silver ions are in catalytic proximity (that is, in reactive association with each other) and preferably are in the same emulsion layer.

Where the materials contain imaging layers on one side of the support only, various non-imaging layers are usually disposed on the "backside" (non-emulsion or non-imaging side) of the materials, including antihalation layer(s), protective layers, antistatic layers, conducting layers, and transport enabling layers.

In such instances, various non-imaging layers can also be disposed on the "frontside" or imaging or emulsion side of the support, including protective topcoat layers, primer layers, interlayers, opacifying layers, antistatic layers, antihalation layers, acutance layers, auxiliary layers, and other layers readily apparent to one skilled in the art.

When the photothermographic materials of this invention are heat-developed as described below in a substantially water-free condition after, or simultaneously with, imagewise exposure, a silver image (preferably a black-and-white silver image) is obtained.

DEFINITIONS

As used herein:

In the descriptions of the photothermographic materials of the present invention, "a" or "an" component refers to "at least one" of that component. For example, the backside stabilizers can be used individually or in combinations.

Heating in a substantially water-free condition as used herein, means heating at a temperature of from about 50° C. to about 250° C. with little more than ambient water vapor present. The term "substantially water-free condition" means that the reaction system is approximately in equilibrium with water in the air and water for inducing or promoting the reaction is not particularly or positively supplied from the exterior to the material. Such a condition is described in T. H. James, *The Theory of the Photographic Process*, Fourth Edition, Eastman Kodak Company, Rochester, N.Y., 1977, p. 374.

"Photothermographic material(s)" means a construction comprising at least one photothermographic emulsion layer or a photothermographic set of layers (wherein the photosensitive silver halide and the source of reducible silver ions are in one layer and the other essential components or desirable additives are distributed, as desired, in the same layer or in an adjacent coating layer) as well as any supports, topcoat layers, image-receiving layers, blocking layers, antihalation layers, subbing or priming layers. These materials also include multilayer constructions in which one or more imaging components are in different layers, but are in "reactive association" so that they readily come into contact with each other during imaging and/or development. For example, one layer can include the non-photosensitive source of reducible silver ions and another layer can include the reducing composition, but the two reactive components are in reactive association with each other.

When used in photothermography, the term, "imagewise exposing" or "imagewise exposure" means that the material is imaged using any exposure means that provides a latent image using electromagnetic radiation. This includes, for example, by analog exposure where an image is formed by projection onto the photosensitive material as well as by digital exposure where the image is formed one pixel at a time such as by modulation of scanning laser radiation.

"Catalytic proximity" or "reactive association" means that the materials are in the same layer or in adjacent layers so that they readily come into contact with each other during thermal imaging and development.

"Emulsion layer," "imaging layer," or "photothermographic emulsion layer," means a layer of a photothermographic material that contains the photosensitive silver halide and/or non-photosensitive source of reducible silver ions. It can also mean a layer of the photothermographic material that contains, in addition to the photosensitive silver halide and/or non-photosensitive source of reducible ions, additional essential components and/or desirable additives. These layers are usually on what is known as the "frontside" of the support.

"Photocatalyst" means a photosensitive compound such as silver halide that, upon exposure to radiation, provides a compound that is capable of acting as a catalyst for the subsequent development of the image-forming material.

Many of the materials used herein are provided as a solution. The term "active ingredient" means the amount or the percentage of the desired material contained in a sample. All amounts listed herein are the amount of active ingredient added.

"Ultraviolet region of the spectrum" refers to that region of the spectrum less than or equal to 410 nm, and preferably from about 100 nm to about 410 nm, although parts of these ranges may be visible to the naked human eye. More preferably, the ultraviolet region of the spectrum is the region of from about 190 to about 405 nm.

"Visible region of the spectrum" refers to that region of the spectrum of from about 400 nm to about 700 nm.

"Short wavelength visible region of the spectrum" refers to that region of the spectrum of from about 400 nm to about 450 nm.

"Red region of the spectrum" refers to that region of the spectrum of from about 600 nm to about 700 nm.

"Infrared region of the spectrum" refers to that region of the spectrum of from about 700 nm to about 1400 nm.

"Non-photosensitive" means not intentionally light sensitive.

The sensitometric terms "photospeed" or "photographic speed," absorbance, $D_{min}$, and $D_{max}$ have conventional definitions known in the imaging arts. Particularly, $D_{min}$ is considered herein as image density achieved when the photothermographic material is thermally developed without prior exposure to radiation. It is the average of eight lowest density values on the exposed side of the fiducial mark.

The sensitometric term "absorbance" is another term for optical density (OD).

"AC-1" (Average Contrast-1) is defined herein as the average contrast between an optical density of 0.6 above $D_{min}$ and an optical density of 2.0 above $D_{min}$.

"SPD-3" (Speed-3) is defined herein as 4-log(E) corresponding to the density value at 2.90 above $D_{min}$, where E is the exposure in ergs/cm$^2$.

"Transparent" means capable of transmitting visible light or imaging radiation without appreciable scattering or absorption.

Toners are compounds that when added to the photothermographic imaging layer shift the color of the developed silver image from yellowish-orange to dark brown-black or blue-black.

As used herein, the phrase "organic silver coordinating ligand" refers to an organic molecule capable of forming a bond with a silver atom. Although the compounds so formed are technically silver coordination compounds they are also often referred to as silver salts.

As is well understood in this art, for the various compounds herein described, substitution is not only tolerated, but is often advisable and various substituents are anticipated on the backside stabilizers used in the present invention (as shown below). Thus, when a compound is referred to as "having the structure" of a given formula, any substitution that does not alter the bond structure of the formula or the shown atoms within that structure is included within the formula, unless such substitution is specifically excluded by language (such as "free of carboxy-substituted alkyl.

As a means of simplifying the discussion and recitation of certain substituent groups, the term "group" refers to chemical species that may be substituted as well as those that are not so substituted. Thus, the term "group," such as "alkyl group" is intended to include not only pure hydrocarbon alkyl chains, such as methyl, ethyl, n-propyl, t-butyl, cyclohexyl, iso-octyl, and octadecyl, but also alkyl chains bearing substituents known in the art, such as hydroxyl, alkoxy, phenyl, halogen atoms (F, Cl, Br, and I), cyano, nitro, amino, and carboxy. For example, alkyl group includes ether and thioether groups (for example $CH_3—CH_2—CH_2—O—CH_2—$ and $CH_3—CH_2—CH_2—S—CH_2—$), haloalkyl, nitroalkyl, alkylcarboxy, carboxyalkyl, carboxamido, hydroxyalkyl, sulfoalkyl, and other groups readily apparent to one skilled in the art. Substituents that adversely react with other active ingredients, such as very strongly electrophilic or oxidizing substituents, would, of course, be excluded by the ordinarily skilled artisan as not being inert or harmless.

In the compounds described herein, no particular double bond geometry (for example, cis or trans) is intended by the structures drawn. Similarly, the alternating single and double bonds and localized charges are drawn as a formalism. In reality, both electron and charge delocalization exists throughout the conjugated chain.

*Research Disclosure* is a publication of Kenneth Mason Publications Ltd., Dudley House, 12 North Street, Emsworth, Hampshire PO10 7DQ England (also available from Emsworth Design Inc., 147 West 24th Street, New York, N.Y. 10011).

Other aspects, advantages, and benefits of the present invention are apparent from the detailed description, examples, and claims provided in this application.

The Photocatalyst

As noted above, the photothermographic materials of the present invention include one or more photocatalysts in the photothermographic emulsion layer(s). Useful photocatalysts are typically photosensitive silver halides such as silver bromide, silver iodide, silver chloride, silver bromoiodide, silver chlorobromoiodide, silver chlorobromide, and others readily apparent to one skilled in the art. Mixtures of silver halides can also be used in any suitable proportion. In preferred embodiments, the silver halide comprises at least 70 mol % silver bromide with the remainder being silver chloride and silver iodide. More preferably, the amount of silver bromide is at least 90 mol %. Silver bromide and silver bromoiodide are more preferred silver halides, with the latter silver halide having up to 10 mol % silver iodide based on total silver halide. Typical techniques for preparing and precipitating silver halide grains are described in *Research Disclosure,* 1978, item 17643.

In some embodiments of aqueous-based photothermographic materials, higher amounts of iodide may be present in the photosensitive silver halide grains, and particularly from about 20 mol % up to the saturation limit of iodide, to increase image stability and to reduce "print-out," as described for example in copending and commonly assigned U.S. Ser. No. 10/246,265 (filed Sep. 18, 2002 by Maskasky and Scaccia).

The shape of the photosensitive silver halide grains used in the present invention is in no way limited. The silver halide grains may have any crystalline habit including, but not limited to, cubic, octahedral, tetrahedral, orthorhombic, rhombic, dodecahedral, other polyhedral, tabular, laminar, twinned, or platelet morphologies and may have epitaxial growth of crystals thereon. If desired, a mixture of these crystals can be employed. Silver halide grains having cubic and tabular morphology are preferred.

The silver halide grains may have a uniform ratio of halide throughout. They may have a graded halide content, with a continuously varying ratio of, for example, silver bromide and silver iodide or they may be of the core-shell type, having a discrete core of one halide ratio, and a discrete shell of another halide ratio. For example, the central regions of the tabular grains may contain at least 1 mol % more iodide than the outer or annular regions of the grains. Core-shell silver halide grains useful in photothermographic materials and methods of preparing these materials are described for example in U.S. Pat. No. 5,382,504 (Shor et al.), incorporated herein by reference. Iridium and/or copper doped core-shell and non-core-shell grains are described in U.S. Pat. No. 5,434,043 (Zou et al.) and U.S. Pat. No. 5,939,249 (Zou), both incorporated herein by reference. Mixtures of preformed silver halide grains having different compositions or dopants grains may be employed.

The photosensitive silver halide can be added to (or formed within) the emulsion layer(s) in any fashion as long as it is placed in catalytic proximity to the non-photosensitive source of reducible silver ions.

It is preferred that the silver halide grains be preformed and prepared by an ex-situ process. The silver halide grains prepared ex-situ may then be added to and physically mixed with the non-photosensitive source of reducible silver ions.

In some formulations it is useful to form the source of reducible silver ions in the presence of ex-situ-prepared silver halide. In this process, the source of reducible silver ions, such as a long chain fatty acid silver carboxylate (commonly referred to as a silver "soap"), is formed in the presence of the preformed silver halide grains. Co-precipitation of the reducible source of silver ions in the presence of silver halide provides a more intimate mixture of the two materials [see, for example U.S. Pat. No. 3,839,049 (Simons)]. Materials of this type are often referred to as "preformed soaps."

In general, the non-tabular silver halide grains used in the imaging formulations can vary in average diameter of up to several micrometers (μm) depending on their desired use. Usually, the silver halide grains have an average particle size of from about 0.01 to about 1.5 μm. In some embodiments, the average particle size is preferable from about 0.03 to about 1.0 μm, and more preferably from about 0.05 to about 0.8 μm. Those of ordinary skill in the art understand that there is a finite lower practical limit for silver halide grains that is partially dependent upon the wavelengths to which the grains are spectrally sensitized. Such a lower limit, for example, is typically from about 0.01 to about 0.005 μm.

The average size of the doped photosensitive silver halide grains is expressed by the average diameter if the grains are spherical, and by the average of the diameters of equivalent circles for the projected images if the grains are cubic, tabular, or other non-spherical shapes.

Grain size may be determined by any of the methods commonly employed in the art for particle size measurement. Representative methods are described by in "Particle Size Analysis," ASTM Symposium on Light Microscopy, R. P. Loveland, 1955, pp. 94–122, and in C. E. K. Mees and T. H. James, *The Theory of the Photographic Process*, Third Edition, Macmillan, New York, 1966, Chapter 2. Particle size measurements may be expressed in terms of the projected areas of grains or approximations of their diameters. These will provide reasonably accurate results if the grains of interest are substantially uniform in shape.

In further embodiments of this invention, the silver halide grains are tabular silver halide grains that are considered "ultrathin" and have an average thickness of at least 0.02 μm and up to and including 0.10 μm. Preferably, these ultrathin grains have an average thickness of at least 0.03 μm and more preferably of at least 0.04 μm, and up to and including 0.08 μm and more preferably up to and including 0.07 μm. In addition, these ultrathin tabular grains have an equivalent circular diameter (ECD) of at least 0.5 μm, preferably at least 0.75 μm, and more preferably at least 1 μm. The ECD can be up to and including 8 μm, preferably up to and including 6 μm, and more preferably up to and including 4 μm. The aspect ratio of the useful tabular grains is at least 5:1, preferably at least 10:1, and more preferably at least 15:1. For practical purposes, the tabular grain aspect is generally up to 50:1. The grain size of ultrathin tabular grains may be determined by any of the methods commonly employed in the art for particle size measurement, such as those described above. Ultrathin tabular grains having these properties are described in U.S. Pat. No. 6,576,410 (Zou et al.).

The ultrathin tabular silver halide grains can also be doped using one or more of the conventional metal dopants known for this purpose including those described in *Research Disclosure*, September 1996, item 38957 and U.S. Pat. No. 5,503,970 (Olm et al.), incorporated herein by reference. Preferred dopants include iridium (III or IV) and ruthenium (II or III) salts.

Preformed silver halide emulsions used in the material of this invention can be prepared by aqueous or organic processes and can be unwashed or washed to remove soluble salts. In the latter case, the soluble salts can be removed by ultrafiltration, by chill setting and leaching, or by washing the coagulum [for example, by the procedures described in U.S. Pat. No. 2,618,556 (Hewitson et al.), U.S. Pat. No. 2,614,928 (Yutzy et al.), U.S. Pat. No. 2,565,418 (Yackel), U.S. Pat. No. 3,241,969 (Hart et al.), and U.S. Pat. No. 2,489,341 (Waller et al.)].

It is also effective to use an in-situ process in which a halide-containing compound is added to an organic silver salt to partially convert the silver of the organic silver salt to silver halide. The halogen-containing compound can be inorganic (such as zinc bromide, calcium bromide, or lithium bromide) or organic (such as N-bromosuccinimide).

Additional methods of preparing these silver halide and organic silver salts and manners of blending them are described in *Research Disclosure*, June 1978, item 17029, U.S. Pat. No. 3,700,458 (Lindholm), U.S. Pat. No. 4,076,539 (Ikenoue et al.), JP Kokai 49-013224 A, (Fuji), JP Kokai 50-017216 A (Fuji), and JP Kokai 51-042529 A (Fuji).

It is particularly effective to use a mixture of both in-situ and ex-situ silver halide grains.

In some instances, it may be helpful to prepare the photosensitive silver halide grains in the presence of a hydroxytetraazaindene (such as 4-hydroxy-6-methyl-1,3,3a,7-tetraazaindene) or an N-heterocyclic compound comprising at least one mercapto group (such as 1-phenyl-5-mercaptotetrazole) to provide increased photospeed. Details of this procedure are provided in U.S. Pat. No. 6,413,710 (Shor et al.), that is incorporated herein by reference.

The one or more light-sensitive silver halides used in the photothermographic materials of the present invention are preferably present in an amount of from about 0.005 to about 0.5 mole, more preferably from about 0.01 to about 0.25 mole, and most preferably from about 0.03 to about 0.15 mole, per mole of non-photosensitive source of reducible silver ions.

Chemical Sensitizers

The photosensitive silver halides used in photothermographic materials of the invention may be employed without modification. However, one or more conventional chemical sensitizers may be used in the preparation of the photosensitive silver halides to increase photospeed. Such compounds may contain sulfur, tellurium, or selenium, or may comprise a compound containing gold, platinum, palladium, ruthenium, rhodium, iridium, or combinations thereof, a reducing agent such as a tin halide or a combination of any of these. The details of these materials are provided for example, in T. H. James, *The Theory of the Photographic Process*, Fourth Edition, Eastman Kodak Company, Rochester, N.Y., 1977, Chapter 5, pp. 149–169. Suitable conventional chemical sensitization procedures are also described in U.S. Pat. No. 1,623,499 (Sheppard et al.), U.S. Pat. No. 2,399,083 (Waller et al.), U.S. Pat. No. 3,297,447 (McVeigh), U.S. Pat. No. 3,297,446 (Dunn), U.S. Pat. No. 5,049,485 (Deaton), U.S. Pat. No. 5,252,455 (Deaton), U.S. Pat. No. 5,391,727 (Deaton), U.S. Pat. No. 5,912,111 (Lok et al.), U.S. Pat. No. 5,759,761 (Lushington et al.), U.S. Pat. No. 6,296,998 (Eikenberry et al), and EP 0 915 371 A1 (Lok et al.).

In addition, mercaptotetrazoles and tetraazaindenes as described in U.S. Pat. No. 5,691,127 (Daubendiek et al.), incorporated herein by reference, can be used as suitable addenda for tabular silver halide grains.

When used, sulfur sensitization is usually performed by adding a sulfur sensitizer and stirring the emulsion at an appropriate temperature for a predetermined time. Various sulfur compounds can be used. Some examples of sulfur sensitizers include thiosulfates, thioureas, thioamides, thiazoles, rhodanines, phosphine sulfides, thiohydantoins, 4-oxo-oxazolidine-2-thiones, dipolysulfides, mercapto compounds, polythionates, and elemental sulfur.

Certain tetrasubstituted thiourea compounds are also useful in the present invention. Such compounds are described, for example in U.S. Pat. No. 6,296,998 (Eikenberry et al.), U.S. Pat. No. 6,322,961 (Lam et al.) and U.S. Pat. No. 6,368,779 (Lynch et al.). Also useful are the tetrasubstituted middle chalcogen (that is, sulfur, selenium, and tellurium) thiourea compounds disclosed in U.S. Pat. No. 4,810,626 (Burgmaier et al.). All of the above publications are incorporated herein by reference.

The amount of the sulfur sensitizer to be added varies depending upon various conditions such as pH, temperature and grain size of silver halide at the time of chemical ripening, it is preferably from $10^{-7}$ to $10^{-2}$ mole per mole of silver halide, and more preferably from $10^{-6}$ to $10^{-4}$ mole per mold of silver halide.

In one embodiment, chemical sensitization is achieved by oxidative decomposition of a sulfur-containing spectral sensitizing dye in the presence of a photothermographic emulsion. Such sensitization is described in U.S. Pat. No. 5,891,615 (Winslow et al.), incorporated herein by reference.

Still other useful chemical sensitizers include certain selenium-containing compounds. When used, selenium sensitization is usually performed by adding a selenium sensitizer and stirring the emulsion at an appropriate temperature for a predetermined time. Some specific examples of useful selenium compounds can be found in U.S. Pat. No. 5,158,892 (Sasaki et al.), U.S. Pat. No. 5,238,807 (Sasaki et al.), U.S. Pat. No. 5,942,384 (Arai et al.) and in co-pending and commonly assigned U.S. Ser. No. 10/082,516 (filed Feb. 25, 2002 by Lynch, Opatz, Gysling, and Simpson). All of the above documents are incorporated herein by reference.

Still other useful chemical sensitizers include certain tellurium-containing compounds. When used, tellurium sensitization is usually performed by adding a tellurium sensitizer and stirring the emulsion at an appropriate temperature for a predetermined time. Tellurium compounds for use as chemical sensitizers can be selected from those described in *J. Chem. Soc., Chem. Commun.* 1980, 635, ibid., 1979, 1102, ibid., 1979, 645, *J. Chem. Soc. Perkin. Trans,* 1980, 1, 2191, *The Chemistry of Organic Selenium and Tellurium Compounds*, S. Patai and Z. Rappoport, Eds., Vol. 1 (1986), and Vol. 2 (1987), U.S. Pat. No. 1,623,499 (Sheppard et al.), U.S. Pat. No. 3,320,069 (Illingsworth), U.S. Pat. No. 3,772,031 (Berry et al.), U.S. Pat. No. 5,215,880 (Kojima et al.), U.S. Pat. No. 5,273,874 (Kojima et al.), U.S. Pat. No. 5,342,750 (Sasaki et al.), U.S. Pat. No. 5,677,120 (Lushington et al.), British Patent 235,211 (Sheppard), British Patent 1,121,496 (Halwig), British Patent 1,295,462 (Hilson et al.) British Patent 1,396,696 (Simons), JP Kokai 04-271341 A (Morio et al.), in co-pending and commonly assigned U.S. Published Application No. 2002-0164549 (Lynch et al.), and in co-pending and commonly assigned U.S. Published Application No. 2003-0073026 (Gysling et al.). All of the above documents are incorporated herein by reference.

The amount of the selenium or tellurium sensitizer used in the present invention varies depending on silver halide grains used or chemical ripening conditions. However, it is generally from $10^{-8}$ to $10^{-2}$ mole per mole of silver halide, preferably on the order of from $10^{-7}$ to $10^{-3}$ mole of silver halide.

Noble metal sensitizers for use in the present invention include gold, platinum, palladium and iridium. Gold sensitization is particularly preferred.

When used, the gold sensitizer used for the gold sensitization of the silver halide emulsion used in the present invention may have an oxidation number of 1 or 3, and may be a gold compound commonly used as a gold sensitizer. U.S. Pat. No. 5,858,637 (Eshelman et al.) describes various Au (I) compounds that can be used as chemical sensitizers. Other useful gold compounds can be found in U.S. Pat. No. 5,759,761 (Lushington et al.). Useful combinations of gold (I) complexes and rapid sulfiding agents are described in U.S. Pat. No. 6,322,961 (Lam et al.). Combinations of gold (III) compounds and either sulfur- or tellurium-containing compounds are useful as chemical sensitizers and are described in U.S. Pat. No. 6,423,481 (Simpson et al.). All of the above references are incorporated herein by reference.

Reduction sensitization may also be used. Specific examples of compounds useful in reduction sensitization include, but are not limited to, stannous chloride, hydrazine ethanolamine, and thioureaoxide. Reduction sensitization may be performed by ripening the grains while keeping the emulsion at pH 7 or above, or at pAg 8.3 or less.

The chemical sensitizers can be used in making the silver halide emulsions in conventional amounts that generally depend upon the average size of the silver halide grains. Generally, the total amount is at least $10^{-10}$ mole per mole of total silver, and preferably from about $10^{-8}$ to about $10^{-2}$ mole per mole of total silver. The upper limit can vary depending upon the compound(s) used, the level of silver halide, and the average grain size and grain morphology, and would be readily determinable by one of ordinary skill in the art.

Spectral Sensitizers

The photosensitive silver halides used in the photothermographic features of the invention may be spectrally sensitized with various spectral sensitizing dyes that are known to enhance silver halide sensitivity to ultraviolet, visible, and/or infrared radiation. Non-limiting examples of sensitizing dyes that can be employed include cyanine dyes, merocyanine dyes, complex cyanine dyes, complex merocyanine dyes, holopolar cyanine dyes, hemicyanine dyes, styryl dyes, and hemioxanol dyes. Cyanine dyes, merocyanine dyes and complex merocyanine dyes are particularly useful. Spectral sensitizing dyes are chosen for optimum photosensitivity, stability, and ease of synthesis. They may be added at any stage in chemical finishing of the photothermographic emulsion.

Suitable sensitizing dyes such as those described in U.S. Pat. No. 3,719,495 (Lea), U.S. Pat. No. 4,396,712 (Kinoshita et al.), U.S. Pat. No. 4,439,520 (Kofron et al.), U.S. Pat. No. 4,690,883 (Kubodera et al.), U.S. Pat. No. 4,840,882 (Iwagaki et al.), U.S. Pat. No. 5,064,753 (Kohno et al.), U.S. Pat. No. 5,281,515 (Delprato et al.), U.S. Pat. No. 5,393,654 (Burrows et al.), U.S. Pat. No. 5,441,866 (Miller et al.), U.S. Pat. No. 5,508,162 (Dankosh), U.S. Pat. No. 5,510,236 (Dankosh), U.S. Pat. No. 5,541,054 (Miller et al.), JP Kokai 2000-063690 (Tanaka et al.), JP Kokai 2000-112054 (Fukusaka et al.), JP Kokai 2000-273329 (Tanaka et al.), JP Kokai 2001-005145 (Arai), JP Kokai 2001-064527 (Oshiyama et al.), and JP Kokai 2001-154305 (Kita et al.), can be used in the practice of the invention. All of the publications noted above are incorporated herein by reference. A summary of generally useful spectral sensitizing dyes is contained in *Research Disclosure*, December 1989, item 308119, Section IV. Additional classes of dyes useful for spectral sensitization, including sensitization at other wavelengths are described in *Research Disclosure,* 1994, item 36544, section V.

Teachings relating to specific combinations of spectral sensitizing dyes also include U.S. Pat. No. 4,581,329 (Sugimoto et al.), U.S. Pat. No. 4,582,786 (Ikeda et al.), U.S. Patent, U.S. Pat. No. 4,609,621 (Sugimoto et al.), U.S. Pat. No. 4,675,279 (Shuto et al.), U.S. Pat. No. 4,678,741 (Yamada et al.), U.S. Pat. No. 4,720,451 (Shuto et al.), U.S. Pat. No. 4,818,675 (Miyasaka et al.), U.S. Pat. No. 4,945,036 (Arai et al.), and U.S. Pat. No. 4,952,491 (Nishikawa et al.). All of the above publications and patents are incorporated herein by reference.

Also useful are spectral sensitizing dyes that decolorize by the action of light or heat. Such dyes are described in U.S. Pat. No. 4,524,128 (Edwards et al.), JP Kokai 2001-109101 (Adachi), JP Kokai 2001-154305 (Kita et al.), and JP Kokai 2001-183770 (Hanyu et al.).

Spectral sensitizing dyes may be used singly or in combination. The dyes are selected for the purpose of adjusting the wavelength distribution of the spectral sensitivity, and for the purpose of supersensitization. When using a combination of dyes having a supersensitizing effect, it is possible to attain much higher sensitivity than the sum of sensitivities that can be achieved by using each dye alone. It is also possible to attain such supersensitizing action by the use of a dye having no spectral sensitizing action by itself, or a compound that does not substantially absorb visible light. Diaminostilbene compounds are often used as supersensitizers.

An appropriate amount of spectral sensitizing dye added is generally about $10^{-10}$ to $10^{-1}$ mole, and preferably, about $10^{-7}$ to $10^{-2}$ mole per mole of silver halide.

Non-Photosensitive Source of Reducible Silver Ions

The non-photosensitive source of reducible silver ions used in the photothermographic materials of this invention can be any organic compound that contains reducible silver (1+) ions. Preferably, it is an organic silver salt that is comparatively stable to light and forms a silver image when heated to 50° C. or higher in the presence of an exposed photocatalyst (such as silver halide) and a reducing composition.

Silver salts of organic acids including silver salts of long-chain carboxylic acids are preferred. The chains typically contain 10 to 30, and preferably 15 to 28, carbon atoms. Suitable organic silver salts include silver salts of organic compounds having a carboxylic acid group. Examples thereof include a silver salt of an aliphatic carboxylic acid or a silver salt of an aromatic carboxylic acid. Preferred examples of the silver salts of aliphatic carboxylic acids include silver behenate, silver arachidate, silver stearate, silver oleate, silver laurate, silver caprate, silver myristate, silver palmitate, silver maleate, silver fumarate, silver tartarate, silver furoate, silver linoleate, silver butyrate, silver camphorate, and mixtures thereof. Preferably, at least silver behenate is used alone or in mixtures with other silver carboxylates.

Representative silver salts of aromatic carboxylic acid and other carboxylic acid group-containing compounds include, but are not limited to, silver benzoate, silver substituted-benzoates (such as silver 3,5-dihydroxy-benzoate, silver o-methylbenzoate, silver m-methylbenzoate, silver p-methylbenzoate, silver 2,4-dichlorobenzoate, silver acetamidobenzoate, silver p-phenylbenzoate), silver tannate, silver phthalate, silver terephthalate, silver salicylate, silver phenylacetate, and silver pyromellitate.

Silver salts of aliphatic carboxylic acids containing a thioether group as described in U.S. Pat. No. 3,330,663 (Weyde et al.) are also useful. Soluble silver carboxylates comprising hydrocarbon chains incorporating ether or thioether linkages, or sterically hindered substitution in the α-(on a hydrocarbon group) or ortho-(on an aromatic group) position, and displaying increased solubility in coating solvents and affording coatings with less light scattering can also be used. Such silver carboxylates are described in U.S. Pat. No. 5,491,059 (Whitcomb). Mixtures of any of the silver salts described herein can also be used if desired.

Silver salts of dicarboxylic acids are also useful. Such acids may be aliphatic, aromatic, or heterocyclic. Examples of such acids include, for example, phthalic acid, glutamic acid, or homo-phthalic acid.

Silver salts of sulfonates are also useful in the practice of this invention. Such materials are described for example in U.S. Pat. No. 4,504,575 (Lee). Silver salts of sulfosuccinates are also useful as described for example in EP 0 227 141A1 (Leenders et al.).

Silver salts of compounds containing mercapto or thione groups and derivatives thereof can also be used. Preferred examples of these compounds include, but are not limited to, a heterocyclic nucleus containing 5 or 6 atoms in the ring, at least one of which is a nitrogen atom, and other atoms being carbon, oxygen, or sulfur atoms. Such heterocyclic nuclei include, but are not limited to, triazoles, oxazoles, thiazoles, thiazolines, imidazoles, diazoles, pyridines, and triazines. Representative examples of these silver salts include, but are not limited to, a silver salt of 3-mercapto-4-phenyl-1,2,4-triazole, a silver salt of 5-carboxylic-1-methyl-2-phenyl-4-thiopyridine, a silver salt of mercaptotriazine, a silver salt of 2-mercaptobenzoxazole, silver salts as described in U.S. Pat. No. 4,123,274 (Knight et al.) (for example, a silver salt of a 1,2,4-mercaptothiazole derivative, such as a silver salt of 3-amino-5-benzylthio-1,2,4-thiazole), and a silver salt of thione compounds [such as a silver salt of 3-(2-carboxyethyl)-4-methyl-4-thiazoline-2-thione as described in U.S. Pat. No. 3,785,830 (Sullivan et al.)].

Examples of other useful silver salts of mercapto or thione substituted compounds that do not contain a heterocyclic nucleus include but are not limited to, a silver salt of thioglycolic acids such as a silver salt of an S-alkyl-thioglycolic acid (wherein the alkyl group has from 12 to 22 carbon atoms), a silver salt of a dithiocarboxylic acid such as a silver salt of a dithioacetic acid, and a silver salt of a thioamide.

Moreover, silver salts of acetylenes can also be used as described, for example in U.S. Pat. No. 4,761,361 (Ozaki et al.) and U.S. Pat. No. 4,775,613 (Hirai et al.).

In some embodiments, a silver salt of a compound containing an imino group can be used, especially in aqueous-based imaging formulations. Preferred examples of these compounds include, but are not limited to, silver salts of benzotriazole and substituted derivatives thereof (for example, silver methyl-benzotriazole and silver 5-chlorobenzotriazole), silver salts of 1,2,4-triazoles or 1-H-tetrazoles such as phenylmercaptotetrazole as described in U.S. Pat. No. 4,220,709 (deMauriac), and silver salts of imidazoles and imidazole derivatives as described in U.S. Pat. No. 4,260,677 (Winslow et al.). Particularly useful silver salts of this type are the silver salts of benzotriazole and substituted derivatives thereof. A silver salt of benzotriazole is preferred in aqueous-based photothermographic formulations.

Organic silver salts that are particularly useful in organic solvent-based photothermographic materials include silver carboxylates (both aliphatic and aromatic carboxylates), silver triazolates, silver sulfonates, silver sulfosuccinates, and silver acetylides. Silver salts of long-chain aliphatic carboxylic acids containing 15 to 28, carbon atoms and silver salts are particularly preferred.

It is also convenient to use silver half soaps. A preferred example of a silver half soap is an equimolar blend of silver carboxylate and carboxylic acid, which analyzes for about 14.5% by weight solids of silver in the blend and which is prepared by precipitation from an aqueous solution of an ammonium or an alkali metal salt of a commercially available fatty carboxylic acid, or by addition of the free fatty acid to the silver soap. For transparent films a silver carboxylate full soap, containing not more than about 15% of free fatty carboxylic acid and analyzing for about 22% silver, can be used. For opaque photothermographic materials, different amounts can be used.

The methods used for making silver soap emulsions are well known in the art and are disclosed in *Research Disclosure*, April 1983, item 22812, *Research Disclosure*, October 1983, item 23419, U.S. Pat. No. 3,985,565 (Gabrielsen et al.) and the references cited above.

Non-photosensitive sources of reducible silver ions can also be provided as core-shell silver salts such as those described in U.S. Pat. No. 6,355,408B1 (Whitcomb et al.), that is incorporated herein by reference. These silver salts include a core comprised of one or more silver salts and a shell having one or more different silver salts.

Another useful source of non-photosensitive reducible silver ions in the practice of this invention are the silver dimer compounds that comprise two different silver salts as described in U.S. Pat. No. 6,472,131B1 (Whitcomb), that is incorporated herein by reference. Such non-photosensitive silver dimer compounds comprise two different silver salts, provided that when the two different silver salts comprise straight-chain, saturated hydrocarbon groups as the silver coordinating ligands, those ligands differ by at least 6 carbon atoms.

Still other useful sources of non-photosensitive reducible silver ions in the practice of this invention are the silver core-shell compounds comprising a primary core comprising one or more photosensitive silver halides, or one or more non-photosensitive inorganic metal salts or non-silver containing organic salts, and a shell at least partially covering the primary core, wherein the shell comprises one or more non-photosensitive silver salts, each of which silver salts comprises a organic silver coordinating ligand. Such compounds are described in copending and commonly assigned U.S. Ser. No. 10/208,603 (filed Jul. 30, 2002 by Bokhonov, Burleva, Whitcomb, Howlader, and Leichter) that is incorporated herein by reference.

As one skilled in the art would understand, the non-photosensitive source of reducible silver ions can include various mixtures of the various silver salt compounds described herein, in any desirable proportions.

The photocatalyst and the non-photosensitive source of reducible silver ions must be in catalytic proximity (that is, reactive association). It is preferred that these reactive components be present in the same emulsion layer.

The one or more non-photosensitive sources of reducible silver ions are preferably present in an amount of about 5% by weight to about 70% by weight, and more preferably, about 10% to about 50% by weight, based on the total dry weight of the emulsion layers. Stated another way, the amount of the sources of reducible silver ions is generally present in an amount of from about 0.001 to about 0.2 $mol/m^2$ of the dry photothermographic material, and preferably from about 0.01 to about 0.05 $mol/m^2$ of that material.

The total amount of silver (from all silver sources) in the photothermographic materials is generally at least 0.002 $mol/m^2$ and preferably from about 0.01 to about 0.05 $mol/m^2$.

Reducing Agents

The reducing agent (or reducing agent composition comprising two or more components) for the source of reducible silver ions can be any material, preferably an organic material, that can reduce silver (I) ion to metallic silver.

Conventional photographic developers can be used as reducing agents, including aromatic di- and tri-hydroxy compounds (such as hydroquinones, gallic acid and gallic acid derivatives, catechols, and pyrogallols), aminophenols (for example, N-methylaminophenol), sulfonamidophenols, p-phenylenediamines, alkoxynaphthols (for example, 4-methoxy-1-naphthol), pyrazolidin-3-one type reducing agents (for example PHENIDONE®), pyrazolin-5-ones, polyhydroxy spiro-bis-indanes, indan-1,3-dione derivatives, hydroxytetrone acids, hydroxytetronimides, hydroxylamine derivatives such as for example those described in U.S. Pat. No. 4,082,901 (Laridon et al.), hydrazine derivatives, hindered phenols, amidoximes, azines, reductones (for example, ascorbic acid and ascorbic acid derivatives), leuco dyes, and other materials readily apparent to one skilled in the art.

When a silver salt of a compound containing an imino group (such as, for example, a silver benzotriazole) is used as the source of reducible silver ions, ascorbic acid reducing agents are preferred. An "ascorbic acid" reducing agent (also referred to as a developer or developing agent) means ascorbic acid, complexes thereof, and derivatives thereof. Ascorbic acid developing agents are described in a considerable number of publications in photographic processes, including U.S. Pat. No. 5,236,816 (Purol et al.) and references cited therein.

Useful ascorbic acid developing agents include ascorbic acid and the analogues, isomers, complexes, and derivatives thereof. Such compounds include, but are not limited to, D- or L-ascorbic acid, 2,3-dihydroxy-2-cyclohexen-1-one, 3,4-dihydroxy-5-phenyl-2(5H)-furanone, sugar-type derivatives thereof (such as sorboascorbic acid, γ-lactoascorbic acid, 6-desoxy-L-ascorbic acid, L-rhamnoascorbic acid, imino-6-desoxy-L-ascorbic acid, glucoascorbic acid, fucoascorbic acid, glucoheptoascorbic acid, maltoascorbic acid, L-arabosascorbic acid), sodium ascorbate, niacinamide ascorbate, potassium ascorbate, isoascorbic acid (or L-erythroascorbic acid), and salts thereof (such as alkali metal, ammonium or others known in the art), endiol type ascorbic acid, an enaminol type ascorbic acid, a thioenol type ascorbic acid, and an enamin-thiol type ascorbic acid, as described for example in U.S. Pat. No. 5,498,511 (Yamashita et al.), EP 0 585 792 A1 (Passarella et al.), EP 0 573 700 A1 (Lingier et al.), EP 0 588 408 A1(Hieronymus et al.), U.S. Pat. No. 5,089,819 (Knapp), U.S. Pat. No. 5,278,035 (Knapp), U.S. Pat. No. 5,384,232 (Bishop et al.), U.S. Pat. No. 5,376,510 (Parker et al.), Japanese Kokai 7-56286 (Toyoda), U.S. Pat. No. 2,688,549 (James et al.), and *Research Disclosure*, March 1995, item 37152. D-, L-, or D,L-ascorbic acid (and alkali metal salts thereof) or isoascorbic acid (or alkali metal salts thereof) are preferred. Sodium ascorbate and sodium isoascorbate are most preferred. Mixtures of these developing agents can be used if desired.

When a silver carboxylate silver source is used, hindered phenol reducing agents are preferred. In some instances, the reducing agent composition comprises two or more components such as a hindered phenol developer and a co-developer that can be chosen from the various classes of co-developers and reducing agents described below. Ternary developer mixtures involving the further addition of contrast enhancing agents are also useful. Such contrast enhancing agents can be chosen from the various classes of reducing agents described below.

"Hindered phenol reducing agents" are compounds that contain only one hydroxy group on a given phenyl ring and have at least one additional substituent located ortho to the hydroxy group. Hindered phenol reducing agents may contain more than one hydroxy group as long as each hydroxy group is located on different phenyl rings. Hindered phenol reducing agents include, for example, binaphthols (that is dihydroxybinaphthyls), biphenols (that is dihydroxybiphenyls), bis(hydroxynaphthyl)methanes, bis(hydroxyphenyl) methanes (that is bisphenols), hindered phenols, and hindered naphthols, each of which may be variously substituted.

Representative binaphthols include, but are not limited, to 1,1'-bi-2-naphthol, 1,1'-bi-4-methyl-2-naphthol and 6,6'-dibromo-bi-2-naphthol. For additional compounds see U.S. Pat. No. 3,094,417 (Workman) and U.S. Pat. No. 5,262,295 (Tanaka et al.), both incorporated herein by reference.

Representative biphenols include, but are not limited, to 2,2'-dihydroxy-3,3'-di-t-butyl-5,5-dimethylbiphenyl, 2,2'-dihydroxy-3,3',5,5'-tetra-t-butylbiphenyl, 2,2'-dihydroxy-3,3'-di-t-butyl-5,5'-dichlorobiphenyl, 2-(2-hydroxy-3-t-butyl-5-methylphenyl)-4-methyl-6-n-hexylphenol, 4,4'-dihydroxy-3,3',5,5'-tetra-t-butylbiphenyl and 4,4'-dihydroxy-3,3',5,5'-tetramethylbiphenyl. For additional compounds see U.S. Pat. No. 5,262,295 (noted above).

Representative bis(hydroxynaphthyl)methanes include, but are not limited to, 4,4'-methylenebis(2-methyl-1-naphthol). For additional compounds see U.S. Pat. No. 5,262,295 (noted above).

Representative bis(hydroxyphenyl)methanes include, but are not limited to, bis(2-hydroxy-3-t-butyl-5-methylphenyl) methane (CAO-5), 1,1'-bis(2-hydroxy-3,5-dimethylphenyl)-3,5,5-trimethylhexane (NONOX® or PERMANAX WSO), 1,1'-bis(3,5-di-t-butyl-4-hydroxyphenyl)methane, 2,2'-bis(4-hydroxy-3-methylphenyl)propane, 4,4'-ethylidene-bis(2-t-butyl-6-methylphenol), 2,2'-isobutylidene-bis(4,6-dimethylphenol) (LOWINOX® 221B46), and 2,2'-bis(3,5-dimethyl-4-hydroxyphenyl)propane. For additional compounds see U.S. Pat. No. 5,262,295 (noted above).

Representative hindered phenols include, but are not limited to, 2,6-di-t-butylphenol, 2,6-di-t-butyl-4-methylphenol, 2,4-di-t-butylphenol, 2,6-dichlorophenol, 2,6-dimethylphenol and 2-t-butyl-6-methylphenol.

Representative hindered naphthols include, but are not limited to, 1-naphthol, 4-methyl-1-naphthol, 4-methoxy-1-naphthol, 4-chloro-1-naphthol and 2-methyl-1-naphthol. For additional compounds see U.S. Pat. No. 5,262,295 (noted above).

Mixtures of hindered phenol reducing agents can be used if desired.

More specific alternative reducing agents that have been disclosed in dry silver systems including amidoximes such as phenylamidoxime, 2-thienylamidoxime and p-phenoxyphenylamidoxime, azines (for example, 4-hydroxy-3,5-dimethoxybenzaldehydrazine), a combination of aliphatic carboxylic acid aryl hydrazides and ascorbic acid [such as 2,2'-bis(hydroxymethyl)-propionyl-β-phenyl hydrazide in combination with ascorbic acid], a combination of polyhydroxybenzene and hydroxylamine, a reductone and/or a hydrazine [for example, a combination of hydroquinone and bis(ethoxyethyl)hydroxylamine], piperidinohexose reductone or formyl-4-methylphenylhydrazine, hydroxamic acids (such as phenylhydroxamic acid, p-hydroxyphenylhydroxamic acid, and o-alanine-hydroxamic acid), a combination of azines and sulfonamidophenols (for example, phenothiazine and 2,6-dichloro-4-benzenesulfonamidophenol), α-cyanophenylacetic acid derivatives (such as ethyl α-cyano-2-methylphenylacetate and ethyl α-cyanophenylacetate), bis-o-naphthols [such as 2,2'-dihydroxy-1-binaphthyl, 6,6'-dibromo-2,2'-dihydroxy-1,1'-binaphthyl, and bis(2-hydroxy-1-naphthyl)-methane], a combination of bis-o-naphthol and a 1,3-dihydroxybenzene derivative (for example, 2,4-dihydroxybenzophenone or 2,4-dihydroxyacetophenone), 5-pyrazolones such as 3-methyl-1-phenyl-5-pyrazolone, reductones (such as dimethylaminohexose reductone, anhydrodihydro-aminohexose reductone and anhydrodihydro-piperidone-hexose reductone), sulfonamidophenol reducing agents (such as 2,6-dichloro-4-benzenesulfonamido-phenol, and p-benzenesulfonamidophenol), indane-1,3-diones (such as 2-phenylindane-1,3-dione), chromans (such as 2,2-dimethyl-7-t-butyl-6-hydroxychroman), 1,4-dihydropyridines (such as 2,6-dimethoxy-3,5-dicarbethoxy-1,4-dihydropyridine), ascorbic acid derivatives (such as 1-ascorbylpalmitate, ascorbylstearate and unsaturated aldehydes and ketones), 3-pyrazolidones, and certain indane-1,3-diones.

An additional class of reducing agents that can be used as developers are substituted hydrazines including the sulfonyl hydrazides described in U.S. Pat. No. 5,464,738 (Lynch et al.). Still other useful reducing agents are described, for example, in U.S. Pat. No. 3,074,809 (Owen), U.S. Pat. No. 3,094,417 (Workman), U.S. Pat. No. 3,080,254 (Grant, Jr.), and U.S. Pat. No. 3,887,417 (Klein et al.). Auxiliary reducing agents may be useful as described in U.S. Pat. No. 5,981,151 (Leenders et al.). All of these patents are incorporated herein by reference.

Useful co-developer reducing agents can also be used as described for example, in U.S. Pat. No. 6,387,605 (Lynch et al.), that is incorporated herein by reference. Examples of these compounds include, but are not limited to, 2,5-dioxocyclopentane carboxaldehydes, 5-(hydroxymethylene)-2,2-dimethyl-1,3-dioxane-4,6-diones, 5-(hydroxymethylene)-1,3-dialkylbarbituric acids, and 2-(ethoxymethylene)-1H-indene-1,3(2H)-diones.

Additional classes of reducing agents that can be used as co-developers are trityl hydrazides and formyl phenyl hydrazides as described in U.S. Pat. No. 5,496,695 (Simpson et al.), 2-substituted malondialdehyde compounds as described in U.S. Pat. No. 5,654,130 (Murray), and 4-substituted isoxazole compounds as described in U.S. Pat. No. 5,705,324 (Murray). Additional developers are described in U.S. Pat. No. 6,100,022 (Inoue et al.). All of the patents above are incorporated herein by reference.

Yet another class of co-developers includes substituted acrylonitrile compounds that are described in U.S. Pat. No. 5,635,339 (Murray) and U.S. Pat. No. 5,545,515 (Murray et al.), both incorporated herein by reference. Examples of such compounds include, but are not limited to, the compounds identified as HET-01 and HET-02 in U.S. Pat. No. 5,635,339 (noted above) and CN-01 through CN-13 in U.S. Pat. No. 5,545,515 (noted above). Particularly useful compounds of this type are (hydroxymethylene)cyanoacetates and their metal salts.

Various contrast enhancing agents can be used in some photothermographic materials with specific co-developers. Examples of useful contrast enhancing agents include, but are not limited to, hydroxylamines (including hydroxylamine and alkyl- and aryl-substituted derivatives thereof), alkanolamines and ammonium phthalamate compounds as described for example, in U.S. Pat. No. 5,545,505 (Simpson), hydroxamic acid compounds as described for example, in U.S. Pat. No. 5,545,507 (Simpson et al.), N-acylhydrazine compounds as described for example, in U.S. Pat. No. 5,558,983 (Simpson et al.), and hydrogen atom donor compounds as described in U.S. Pat. No. 5,637,449 (Harring et al.). All of the patents above are incorporated herein by reference.

The reducing agent (or mixture thereof) described herein is generally present as 1 to 10% (dry weight) of the emulsion layer. In multilayer constructions, if the reducing agent is added to a layer other than an emulsion layer, slightly higher proportions, of from about 2 to 15 weight % may be more desirable. Any co-developers may be present generally in an amount of from about 0.001% to about 1.5% (dry weight) of the emulsion layer coating.

Backside Stabilizers

The benefits of the present invention are achieved by incorporating one or more of certain compounds in a non-photosensitive backside layer of the photothermographic materials. This non-photosensitive backside layer can be a carrier layer, an interlayer, antistatic layer, topcoat protective layer, antihalation layer, or other layer on that side. Preferably, the backside stabilizers are introduced through a layer separate from the antihalation layer. In some embodiments, the backside layer containing the backside stabilizers is the sole layer on the backside of the support. In other embodiments, the backside stabilizers are present in one or more of a plurality of layers disposed on the backside of the support.

The backside stabilizers useful in the photothermographic materials of this invention are amine organic bases, each of whose conjugate acid has a pKa greater than 5, and preferably greater than 7. Preferably, these compounds also exhibit a vapor pressure of less than 8 torr at a temperature of 25° C. A mixture of two or more of backside stabilizers can be used in one or more backside layers if desired.

Preferred backside stabilizers can be represented by the following Structure I:

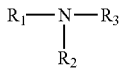

(I)

wherein $R_1$, $R_2$, and $R_3$ are independently chosen from hydrogen, —C($R_4$)═N$R_5$, —C(N$R_6R_7$)═N$R_5$, substituted or unsubstituted alkyl groups having 1 to 18 carbon atoms (such as methyl, ethyl, iso-propyl, n-pentyl, decyl, dodecyl, t-butyl, allyl, benzyl, methoxyethyl, hexyl, and octadecyl groups), and substituted or unsubstituted cycloalkyl groups (such as cyclopentyl, cyclohexyl, cyclopropyl, and cycloheptyl groups), and $R_4$, $R_5$, $R_6$, and $R_7$ are independently the chosen from the same groups as $R_1$, $R_2$, and $R_3$.

In addition, $R_1$, $R_2$, and $R_3$ independently can be substituted or unsubstituted alkenyl groups having 2 to 18 carbon atoms (such as vinyl, propenyl, butenyl, and hexenyl groups), substituted or unsubstituted carbocyclic aryl groups having 6 or 10 carbon atoms in the aromatic rings (such as phenyl, naphthyl, 3,methylphenyl, 4-chlorophenyl and 3-methoxyphenyl groups), or substituted or unsubstituted heterocyclic groups having 5 to 10 carbon, nitrogen, sulfur, and oxygen atoms (such as piperidinyl, morphinyl, piperazinyl, tetrahydropyranyl, pyrrolidinyl, pyridinyl, furanyl, thiophenyl, benzimidazole, and benzoxazole groups).

Alternatively, any one or more of $R_1$, $R_2$, $R_3$, $R_4$, $R_5$, $R_6$, and $R_7$ may be joined with each other and/or the central nitrogen atom to complete one or more substituted or unsubstituted heterocyclic ring(s). Examples of such compounds include 1,5-diazabicyclo[4.3.0]non-5-ene (DBN, compound AB-4), and 1,8-diazabicyclo[5.4.0]undec-7-ene (DBU, compound AB-6).

In addition, $R_1$, $R_2$, $R_3$, $R_4$, $R_5$, $R_6$, and $R_7$ can be substituted with a wide variety of substituents that would be readily apparent to one skilled in the art, and including but not limited to alkyl, aryl, and heterocyclic groups, primary, secondary and tertiary amino, hydroxy, alkoxy, aryloxy groups, halogen, thioethers, carboxy, carboxylic esters and amides, ketones, imines, and guanidines.

It is particularly preferred that $R_1$, $R_2$, and $R_3$, are independently substituted or unsubstituted alkyl, —C($R_4$)═N$R_5$, or —C(N$R_6R_7$)═N$R_5$, groups.

Representative backside stabilizers useful in the practice of this invention include, but are not limited to compounds (AB-1) to (AB-24) shown below.

(AB-1)

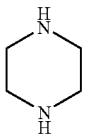

(AB-2)

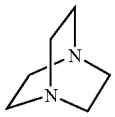

(AB-3)

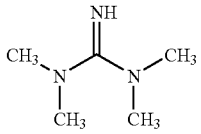

(AB-4)

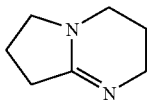

(AB-5)

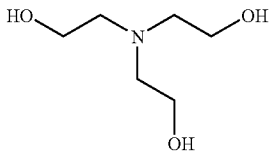

(AB-6)

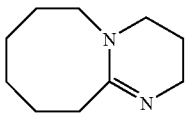

(AB-7)

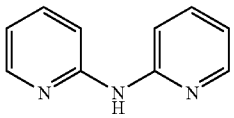

(AB-8)

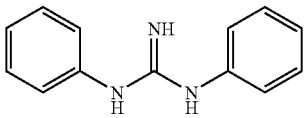

-continued
(AB-9)
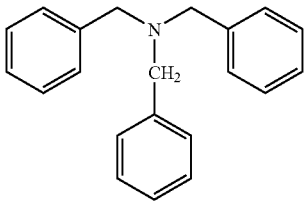
(AB-10)
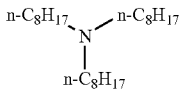
(AB-11)
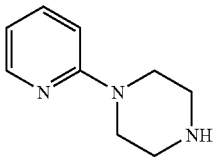
(AB-12)
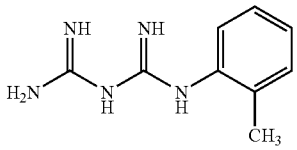
(AB-13)
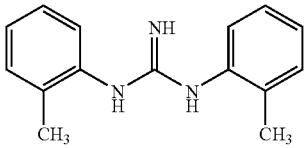
(AB-14)
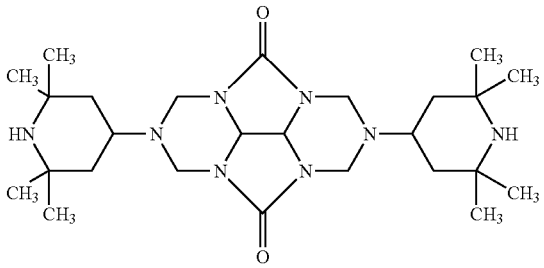
(AB-15)
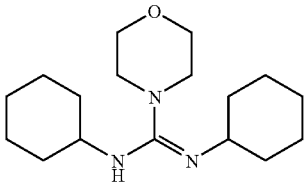
(AB-16)
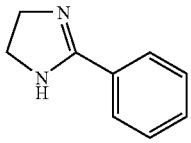
(AB-17)
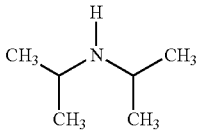
(AB-18)
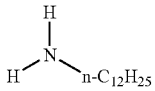
(AB-19)
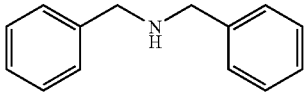
(AB-20)
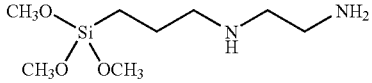
(AB-21)
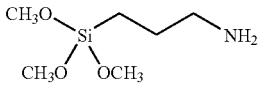
(AB-22)
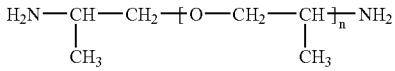
where n is between 5 and 6.
(AB-23)
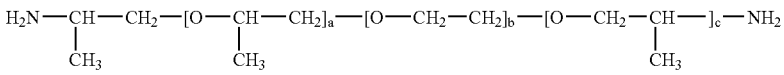
where a +c is 3.6 and b is 9
(AB-24)
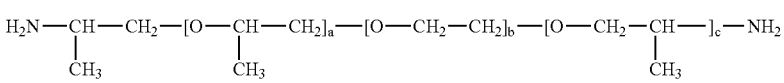
where a +c is 6 and b is 12.5

Compound (AB-22) is Jeffamine D-400. It is a diamine terminated polyoxypropylene diol with between 5 and 6 polyoxypropylene units in the chain.

Compound (AB-23) is Jeffamine ED-600. It is a diamine terminated copolymer of polypropylene oxide/polyethylene oxide with an average of 3.6 polyoxypropylene units and 9 polyethylene oxide units in the chain.

Compound (AB-24) is Jeffamine ED-900. It is a diamine terminated copolymer of polypropylene oxide/polyethylene oxide with an average of 6 polyoxypropylene units and 12.5 polyethylene oxide units in the chain.

The above backside stabilizers can be obtained from a number of commercial sources (such as Aldrich Chemical Co.) or prepared using known procedures as described for example in R. C. Larock, *Comprehensive Organic Transformations—A Guide to Functional Groups Preparations,* 2$^{nd}$ Ed., Wiley-VCH, New York, 1999.

Also useful are mono-, di-, and tri-aliphatic amines that are attached to the ends of polyoxyalkylene chains. These amines include compounds that contain two or more amino groups that are attached to the ends of polyoxyalkylene chains that are based either on propylene oxide, ethylene oxide, or mixed ethylene/propylene oxide. Amines of this type can be obtained from a number of commercial chemical sources including Huntsman Performance Chemicals, (Houston, Tex.) under the name JEFFAMINE®. Other useful aliphatic amines can be obtained from Akzo Nobel under the names: ARMEEN® HT (hydrogenated alkyltallowamine), DOUMEEN® (diamine), TRIAMEEN® (higher amine), ETHOMEEN® (ethoxylated amine), ETHODUMEEN® (ethoxylated diamine), and PROPOMEEN® (propoxylated amine). Additional useful aliphatic amines can be obtained from Nitroil Europe Handels GmbH. (Hamburg, Germany) under the names PC AMINE® DA 250, PC AMINE® DA 400, PC AMINE® DA 2000, and PC AMINE® MA 3000. These materials can also be obtained in the United States from Performance Chemical International Corp. (Houston, Tex.).

The backside stabilizers may also be defined as compounds that provide a pH of at least 8, and preferably of at least 9, when they are dissolved at 0.005 mol/l in an aqueous solution containing water and methanol (15% v/v).

The backside stabilizer(s) used in the present invention are present in one or more backside layers in a total amount on the backside of at least 0.01 mmol/m$^2$, preferably from about 0.1 to about 10 mmol/m$^2$, and more preferably from about 0.05 to about 2 mmol/m$^2$.

In preferred embodiments, the backside stabilizers are incorporated within non-photosensitive compositions that include one or more antihalation compositions (such as antihalation dyes or heat-bleachable compositions as described below), one or more suitable binders (such as any of those described in the following section, but preferably cellulose acetate binders), and other addenda normally included in such compositions (such as matting agents, lubricants, antistatic or conductive materials, and cross-linkers). Such compositions can be formulated in suitable solvents including the conventional organic solvents described below for the photothermographic formulations. The amount of backside stabilizer(s) in such non-photosensitive compositions can be at least 0.01 weight % and preferably from about 0.1 to about 10 weight %, based on total composition dry weight.

The examples below demonstrate how the backside stabilizers can be incorporated into coating formulations or antihalation compositions and used in the photothermographic materials of the present invention.

Toners

The use of "toners" or derivatives thereof that improve the image are highly desirable components of the photothermographic materials of this invention. Toners are compounds that improve image color by contributing to formation of a black image upon development. They may also facilitate an increase the optical density of the developed image. Without them, images are often faint and yellow or brown. Generally, one or more toners described herein are present in an amount of about 0.01% by weight to about 10%, and more preferably about 0.1% by weight to about 10% by weight, based on the total dry weight of the layer in which it is included. The amount can also be defined as being within the range of from about $1\times10^{-5}$ to about 1.0 mol per mole of non-photosensitive source of reducible silver in the photothermographic material. Toners may be incorporated in one or more of the thermally developable imaging layers as well as in adjacent layers such as a protective overcoat or underlying "carrier" layer.

Such compounds are well known materials in the photothermographic art, as shown in U.S. Pat. No. 3,080,254 (Grant, Jr.), U.S. Pat. No. 3,847,612 (Winslow), U.S. Pat. No. 4,123,282 (Winslow), U.S. Pat. No. 4,082,901 (Laridon et al.), U.S. Pat. No. 3,074,809 (Owen), U.S. Pat. No. 3,446,648 (Workman), U.S. Pat. No. 3,844,797 (Willems et al.), U.S. Pat. No. 3,951,660 (Hagemann et al.), U.S. Pat. No. 5,599,647 (Defieuw et al.), and GB 1,439,478 (AGFA).

Examples of toners include, but are not limited to, phthalimide and N-hydroxyphthalimide, cyclic imides (such as succinimide), pyrazoline-5-ones, quinazolinone, 1-phenylurazole, 3-phenyl-2-pyrazoline-5-one, and 2,4-thiazolidinedione, naphthalimides (such as N-hydroxy-1,8-naphthalimide), cobalt complexes [such as hexaaminecobalt(3+) trifluoroacetate], mercaptans (such as 3-mercapto-1,2,4-triazole, 2,4-dimercaptopyrimidine, 3-mercapto-4,5-diphenyl-1,2,4-triazole and 2,5-dimercapto-1,3,4-thiadiazole), N-(amino-methyl)aryldicarboximides (such as (N,N-dimethylaminomethyl)phthalimide), and N-(dimethylaminomethyl)naphthalene-2,3-dicarboximide, a combination of blocked pyrazoles, isothiuronium derivatives, and certain photobleach agents [such as a combination of N,N'-hexamethylene-bis(1-carbamoyl-3,5-dimethyl-pyrazole), 1,8-(3,6-diazaoctane)bis(isothiuronium)trifluoroacetate, and 2-(tribromomethylsulfonyl benzothiazole)], merocyanine dyes {such as 3-ethyl-5-[(3-ethyl-2-benzothiazolinylidene)-1-methyl-ethylidene]-2-thio-2,4-o-azolidine-dione}, phthalazine and derivatives thereof [such as those described in U.S. Pat. No. 6,146,822 (Asanuma et al.)], phthalazinone and phthalazinone derivatives, or metal salts or these derivatives [such as 4-(1-naphthyl)phthalazinone, 6-chlorophthalazinone, 5,7-dimethoxyphthalazinone, and 2,3-dihydro-1,4-phthalazinedione], a combination of phthalazine (or derivative thereof) plus one or more phthalic acid derivatives (such as phthalic acid, 4-methylphthalic acid, 4-nitrophthalic acid, and tetrachlorophthalic anhydride), quinazolinediones, benzoxazine or naphthoxazine derivatives, rhodium complexes functioning not only as tone modifiers but also as sources of halide ion for silver halide formation in-situ [such as ammonium hexachlororhodate (3+), rhodium bromide, rhodium nitrate, and potassium hexachlororhodate (3+)], benzoxazine-2,4-diones (such as 1,3-benzoxazine-2,4-dione, 8-methyl-1,3-benzoxazine-2,4-dione and 6-nitro-1,3-benzoxazine-2,4-dione), pyrimidines and asym-triazines (such as 2,4-dihydroxypyrimidine, 2-hydroxy-4-aminopyrimidine and azauracil) and tetraazapentalene derivatives [such as 3,6-dimercapto-1,4-diphenyl-1H,4H-2,3a,5,6a-tetraazapentalene and 1,4-di-(o-chlorophenyl)-3,6-dimercapto-1H,4H-2,3a,5,6a-tetraazapentalene].

Phthalazine and phthalazine derivatives [such as those described in U.S. Pat. No. 6,146,822 (noted above), incorporated herein by reference], phthalazinone, and phthalazinone derivatives are particularly useful toners.

Additional useful toners are substituted and unsubstituted mercaptotriazoles as described for example in U.S. Pat. No. 3,832,186 (Masuda et al.), U.S. Pat. No. 6,165,704 (Miyake et al.), U.S. Pat. No. 5,149,620 (Simpson et al.), and in copending and commonly assigned U.S. Ser. No. 10/193,443 (filed Jul. 11, 2002 by Lynch, Zou, and Ulrich), U.S. Ser. No. 10/192,944 (filed Jul. 11, 2002 by Lynch, Ulrich, and Zou), and U.S. Ser. No. 10/341,754 (filed Jan. 14, 2003 by Lynch, Ulrich, and Skoug). All of the above documents are incorporated herein by reference.

Also useful are the triazine thione compounds described in U.S. Ser. No. 10/341,754 (filed Jan. 14, 2003 by Lynch, Ulrich, and Skoug), and the heterocyclic disulfide compounds described in U.S. Ser. No. 10/384,244 (filed Mar. 7, 2003 by Lynch and Ulrich), both of which are incorporated herein by reference.

Other useful toners are the phthalazine compounds described in U.S. Pat. No. 6,605,418 (Ramsden et al.), incorporated herein by reference.

Other Addenda

The photothermographic materials of the invention can also contain other additives such as shelf-life stabilizers, antifoggants, contrast enhancing agents, development accelerators, acutance dyes, post-processing stabilizers or stabilizer precursors, thermal solvents (also known as melt formers), humectants, and other image-modifying agents as would be readily apparent to one skilled in the art.

To further control the properties of photothermographic materials, (for example, contrast, $D_{min}$, speed, or fog), it may be preferable to add one or more heteroaromatic mercapto compounds or heteroaromatic disulfide compounds of the formulae Ar—S—$M^1$ and Ar—S—S—Ar, wherein $M^1$ represents a hydrogen atom or an alkali metal atom and Ar represents a heteroaromatic ring or fused heteroaromatic ring containing one or more of nitrogen, sulfur, oxygen, selenium, or tellurium atoms. Preferably, the heteroaromatic ring comprises benzimidazole, naphthimidazole, benzothiazole, naphthothiazole, benzoxazole, naphthoxazole, benzoselenazole, benzotellurazole, imidazole, oxazole, pyrazole, triazole, thiazole, thiadiazole, tetrazole, triazine, pyrimidine, pyridazine, pyrazine, pyridine, purine, quinoline, or quinazolinone. Compounds having other heteroaromatic rings and compounds providing enhanced sensitization at other wavelengths are also envisioned to be suitable. For example, heteroaromatic mercapto compounds are described as supersensitizers for infrared photothermographic materials in EP 0 559 228 B1 (Philip Jr. et al.).

The photothermographic materials of the present invention can be further protected against the production of fog and can be stabilized against loss of sensitivity during storage. While not necessary for the practice of the invention, it may be advantageous to add mercury (II) salts to the emulsion layer(s) as an antifoggant. Preferred mercury (II) salts for this purpose are mercuric acetate and mercuric bromide. Other useful mercury salts include those described in U.S. Pat. No. 2,728,663 (Allen).

Other suitable antifoggants and stabilizers that can be used alone or in combination include thiazolium salts as described in U.S. Pat. No. 2,131,038 (Staud) and U.S. Pat. No. 2,694,716 (Allen), azaindenes as described in U.S. Pat. No. 2,886,437 (Piper), triazaindolizines as described in U.S. Pat. No. 2,444,605 (Heimbach), the urazoles described in U.S. Pat. No. 3,287,135 (Anderson), sulfocatechols as described in U.S. Pat. No. 3,235,652 (Kennard), the oximes described in GB 623,448 (Carrol et al.), polyvalent metal salts as described in U.S. Pat. No. 2,839,405 (Jones), thiuronium salts as described in U.S. Pat. No. 3,220,839 (Herz), palladium, platinum, and gold salts as described in U.S. Pat. No. 2,566,263 (Trirelli) and U.S. Pat. No. 2,597,915 (Damshroder), compounds having —$SO_2CBr_3$ groups as described for example in U.S. Pat. No. 5,594,143 (Kirk et al.) and U.S. Pat. No. 5,374,514 (Kirk et al.), and 2-(tribromomethylsulfonyl)quinoline compounds as described in U.S. Pat. No. 5,460,938 (Kirk et al.).

Stabilizer precursor compounds capable of releasing stabilizers upon application of heat during development can also be used. Such precursor compounds are described in for example, U.S. Pat. No. 5,158,866 (Simpson et al.), U.S. Pat. No. 5,175,081 (Krepski et al.), U.S. Pat. No. 5,298,390 (Sakizadeh et al.), and U.S. Pat. No. 5,300,420 (Kenney et al.).

In addition, certain substituted-sulfonyl derivatives of benzotriazoles (for example alkylsulfonylbenzotriazoles and arylsulfonylbenzotriazoles) have been found to be useful stabilizing compounds (such as for post-processing print stabilizing), as described in U.S. Pat. No. 6,171,767 (Kong et al.).

Furthermore, other specific useful antifoggants/stabilizers are described in more detail in U.S. Pat. No. 6,083,681 (Lynch et al.), incorporated herein by reference.

The photothermographic materials may also include one or more polyhalo antifoggants that include one or more polyhalo substituents including but not limited to, dichloro, dibromo, trichloro, and tribromo groups. The antifoggants can be aliphatic, alicyclic or aromatic compounds, including aromatic heterocyclic and carbocyclic compounds.

Particularly useful antifoggants of this type are polyhalo antifoggants, such as those having a —$SO_2C(X')_3$ group wherein X' represents the same or different halogen atoms.

Another class of useful antifoggants includes those compounds described in U.S. Pat. No. 6,514,678 (Burgmaier et al.), incorporated herein by reference.

The photothermographic materials of this invention may also include one or more thermal solvents (also called "heat solvents," "thermosolvents," "melt formers," "melt modifiers," "eutectic formers," "development modifiers," "waxes," or "plasticizers") for improving the reaction speed of the silver-developing redox reaction at elevated temperature.

By the term "thermal solvent" in this invention is meant an organic material that becomes a plasticizer or liquid solvent for at least one of the imaging layers upon heating at a temperature above 60° C. Useful for that purpose are polyethylene glycols having a mean molecular weight in the range of 1,500 to 20,000 described in U.S. Pat. No. 3,347,675 (Henn et al.). Also useful are compounds such as urea, methyl sulfonamide, and ethylene carbonate as described in U.S. Pat. No. 3,667,959 (Bojara et al.), and compounds such as tetrahydrothiophene-1,1-dioxide, methyl anisate, and 1,10-decanediol as described in *Research Disclosure*, December 1976, item 15027, pp. 26–28. Other representative examples of such compounds include, but are not limited to, niacinamide, hydantoin, 5,5-dimethylhydantoin, salicylanilide, phthalimide, N-hydroxyphthalimide, N-potassium-phthalimide, succinimide, N-hydroxy-1,8-naphthalimide, phthalazine, 1-(2H)-phthalazinone, 2-acetylphthalazinone, benzanilide, 1,3-dimethylurea, 1,3-diethylurea, 1,3-diallylurea, meso-erythritol, D-sorbitol, tetrahydro-2-pyrimidone, glycouril, 2-imidazolidone, 2-imidazolidone-4-carboxylic acid, and benzenesulfonamide. Combinations of these compounds can also be used including, for example, a combination of succinimide and 1,3-dimethylurea. Known thermal solvents are disclosed, for example, in U.S. Pat. No. 6,013,420 (Windender), U.S. Pat. No. 3,438,776 (Yudelson), U.S. Pat. No. 5,368,979 (Freedman et al.), U.S. Pat. No. 5,716,772 (Taguchi et al.), U.S. Pat. No. 5,250,386 (Aono et al.), and in *Research Disclosure*, December 1976, item 15022.

Binders

The photocatalyst (such as the photosensitive silver halide), the non-photosensitive source of reducible silver ions, the reducing agent composition, toner(s), and any other additives used in the present invention are added to and coated in one or more binders using a suitable solvent. For example, organic solvent-based or aqueous-based formulations can be used to prepare the photothermographic materials of this invention. Mixtures of different types of hydrophilic and/or hydrophobic binders can also be used in these formulations.

Examples of useful hydrophilic binders include, but are not limited to, proteins and protein derivatives, gelatin and gelatin derivatives (hardened or unhardened, including alkali- and acid-treated gelatins, and deionized gelatin), cellulosic materials such as hydroxymethyl cellulose and cellulosic esters, acrylamide/methacrylamide polymers, acrylic/methacrylic polymers, polyvinyl pyrrolidones, polyvinyl alcohols, poly(vinyl lactams), polymers of sulfoalkyl acrylate or methacrylates, hydrolyzed polyvinyl acetates, polyamides, polysaccharides (such as dextrans and starch ethers), and other naturally occurring or synthetic vehicles commonly known for use in aqueous-based photographic emulsions (see for example *Research Disclosure*, September 1996, item 38957, noted above). Cationic starches can also be used as peptizers for emulsions containing tabular grain silver halides as described in U.S. Pat. No. 5,620,840 (Maskasky) and U.S. Pat. No. 5,667,955 (Maskasky).

Particularly useful hydrophilic binders are gelatin, gelatin derivatives, polyvinyl alcohols, and cellulosic materials. Gelatin and its derivatives are most preferred, and comprise at least 75 weight % of total binders when a mixture of binders is used.

Aqueous dispersions of water-dispersible polymer latexes may also be used, alone or with hydrophilic or hydrophobic binders described herein. Such dispersions are described in, for example, U.S. Pat. No. 4,504,575 (Lee), U.S. Pat. No. 6,083,680 (Ito et al), U.S. Pat. No. 6,100,022 (Inoue et al.), U.S. Pat. No. 6,132,949 (Fujita et al.), U.S. Pat. No. 6,132,950 (Ishigaki et al.), U.S. Pat. No. 6,140,038 (Ishizuka et al.), U.S. Pat. No. 6,150,084 (Ito et al.), U.S. Pat. No. 6,312,885 (Fujita et al.), U.S. Pat. No. 6,423,487 (Naoi), all of which are incorporated herein by reference.

Hardeners for various binders may be present if desired. Useful hardeners are well known and include diisocyanate compounds as described for example, in EP 0 600 586 B1 (Philip, Jr. et al.) and vinyl sulfone compounds as described in U.S. Pat. No. 6,143,487 (Philip, Jr. et al.), and EP 0 640 589 A1 (Gathmann et al.), aldehydes and various other hardeners as described in U.S. Pat. No. 6,190,822 (Dickerson et al.). The hydrophilic binders used in the photothermographic materials are generally partially or fully hardened using any conventional hardener. Useful hardeners are well known and are described, for example, in T. H. James, *The Theory of the Photographic Process*, Fourth Edition, Eastman Kodak Company, Rochester, N.Y., 1977, Chapter 2, pp. 77–78.

In some embodiments, the components needed for imaging can be added to one or more binders that are predominantly (at least 50% by weight of total binders) hydrophobic in nature. Thus, organic solvent-based formulations can be used to prepare the photothermographic materials of this invention. Mixtures of hydrophobic binders can also be used. It is preferred that at least 80% (by weight) of the binders be hydrophobic polymeric materials such as, for example, natural and synthetic resins that are sufficiently polar to hold the other ingredients in solution or suspension.

Examples of typical hydrophobic binders include, but are not limited to, polyvinyl acetals, polyvinyl chloride, polyvinyl acetate, cellulose acetate, cellulose acetate butyrate, polyolefins, polyesters, polystyrenes, polyacrylonitrile, polycarbonates, methacrylate copolymers, maleic anhydride ester copolymers, butadiene-styrene copolymers, and other materials readily apparent to one skilled in the art. Copolymers (including terpolymers) are also included in the definition of polymers. The polyvinyl acetals (such as polyvinyl butyral and polyvinyl formal), cellulose ester polymers, and vinyl copolymers (such as polyvinyl acetate and polyvinyl chloride) are preferred. Particularly suitable binders are polyvinyl butyral resins that are available as BUTVAR® B79 (Solutia, Inc.) and PIOLOFORM® BS-18, PIOLOFORM® BN-18, PIOLOFORM® BM-18, or PIOLOFORM® BL-16 (Wacker Chemical Company) and cellulose ester polymers.

Where the proportions and activities of the photothermographic materials require a particular developing time and temperature, the binder(s) should be able to withstand those conditions. Generally, it is preferred that the binder does not decompose or lose its structural integrity at 120° C. for 60 seconds. It is more preferred that it does not decompose or lose its structural integrity at 177° C. for 60 seconds.

The polymer binder(s) is used in an amount sufficient to carry the components dispersed therein. The effective range of binder amount can be appropriately determined by one skilled in the art. Preferably, a binder is used at a level of about 10% by weight to about 90% by weight, and more preferably at a level of about 20% by weight to about 70% by weight, based on the total dry weight of the layer in which it is included.

Support Materials

The photothermographic materials of this invention comprise a polymeric support that is preferably a flexible, transparent film that has any desired thickness and is composed of one or more polymeric materials, depending upon their use. The supports are generally transparent (especially if the material is used as a photomask) or at least translucent, but in some instances, opaque supports may be useful. They are required to exhibit dimensional stability during thermal development and to have suitable adhesive properties with overlying layers. Useful polymeric materials for making such supports include, but are not limited to, polyesters (such as polyethylene terephthalate and polyethylene naphthalate), cellulose acetate and other cellulose esters, polyvinyl acetal, polyolefins (such as polyethylene and polypropylene), polycarbonates, and polystyrenes (and polymers of styrene derivatives). Preferred supports are composed of polymers having good heat stability, such as polyesters and polycarbonates. Polyethylene terephthalate film is a particularly preferred support. Various support materials are described, for example, in *Research Disclosure*, August 1979, item 18431. Support materials may also be treated or annealed to reduce shrinkage and promote dimensional stability. A method of making dimensionally stable polyester films is described in *Research Disclosure*, September 1999, item 42536.

It is also useful to use supports comprising dichroic mirror layers wherein the dichroic mirror layer reflects radiation at least having the predetermined range of wavelengths to the emulsion layer and transmits radiation having wavelengths outside the predetermined range of wavelengths. Such dichroic supports are described in U.S. Pat. No. 5,795,708 (Boutet), incorporated herein by reference.

It is further possible to use transparent, multilayer, polymeric supports comprising numerous alternating layers of at least two different polymeric materials. Such multilayer polymeric supports preferably reflect at least 50% of actinic radiation in the range of wavelengths to which the photothermographic sensitive material is sensitive, and provide photothermographic materials having increased speed. Such transparent, multilayer, polymeric supports are described in U.S. Pat. No. 6,630,283 (Simpson et al.) that is incorporated herein by reference.

Opaque supports such as dyed polymeric films and resin-coated papers that are stable to high temperatures can also be used.

Support materials can contain various colorants (such as blue tinting dyes), pigments, antihalation or acutance dyes if desired. Support materials may be treated using conventional procedures (such as corona discharge) to improve adhesion of overlying layers, or subbing or other adhesion-promoting layers can be used. Useful subbing layer formulations include those conventionally used for photographic materials such as vinylidene halide polymers.

Photothermographic Formulations

The formulation for the photothermographic emulsion layer(s) can be prepared by dissolving and dispersing the binder, the photocatalyst, the non-photosensitive source of reducible silver ions, the reducing composition, and optional addenda in an organic solvent, such as toluene, 2-butanone (methyl ethyl ketone), acetone, or tetrahydrofuran.

Alternatively, these components can be formulated with a hydrophilic or water-dispersible polymer latex binder in water or water-organic solvent mixtures to provide aqueous-based coating formulations.

The photothermographic materials of the invention can contain plasticizers and lubricants such as polyalcohols and diols of the type described in U.S. Pat. No. 2,960,404 (Milton et al.), fatty acids or esters such as those described in U.S. Pat. No. 2,588,765 (Robijns) and U.S. Pat. No. 3,121,060 (Duane), and silicone resins such as those described in GB 955,061 (DuPont). The materials can also contain matting agents such as starch, titanium dioxide, zinc oxide, silica, and polymeric beads including beads of the type described in U.S. Pat. No. 2,992,101 (Jelley et al.) and U.S. Pat. No. 2,701,245 (Lynn). Polymeric fluorinated surfactants may also be useful in one or more layers of the materials for various purposes, such as improving coatability and optical density uniformity as described in U.S. Pat. No. 5,468,603 (Kub).

U.S. Pat. No. 6,436,616 (Geisler et al.) describes various means of modifying photothermographic materials to reduce what is known as the "woodgrain" effect, or uneven optical density. This effect can be reduced or eliminated by several means, including treatment of the support, adding matting agents to the topcoat, using acutance dyes in certain layers or other procedures described therein.

The photothermographic materials of this invention can include antistatic or conducting layers. Such layers may contain soluble salts (for example, chlorides or nitrates), evaporated metal layers, or ionic polymers such as those described in U.S. Pat. No. 2,861,056 (Minsk) and U.S. Pat. No. 3,206,312 (Sterman et al.), or insoluble inorganic salts such as those described in U.S. Pat. No. 3,428,451 (Trevoy), electroconductive underlayers such as those described in U.S. Pat. No. 5,310,640 (Markin et al.), electronically-conductive metal antimonate particles such as those described in U.S. Pat. No. 5,368,995 (Christian et al.), and electrically-conductive metal-containing particles dispersed in a polymeric binder such as those described in EP 0 678 776 A1 (Melpolder et al.). Particularly useful conductive particles are the non-acicular metal antimonate particles described in copending and commonly assigned U.S. Ser. No. 10/304,224 (filed on Nov. 27, 2002 by LaBelle, Sakizadeh, Ludemann, Bhave, and Pham). One such material is non-acicular zinc antimonate particles. All of the above patents and patent applications are incorporated herein by reference. Other antistatic agents are well known in the art.

Other conductive compositions include one or more fluoro-chemicals each of which is a reaction product of $R_f$—$CH_2CH_2$—$SO_3H$ with an amine wherein $R_f$ comprises 4 or more fully fluorinated carbon atoms. These antistatic compositions are described in more detail in copending and commonly assigned U.S. Ser. No. 10/107,551 (filed Mar. 27, 2002 by Sakizadeh, LaBelle, Orem, and Bhave) that is incorporated herein by reference.

Additional conductive compositions include one or more fluoro-chemicals having the structure $R_f$—R—$N(R'_1)(R'_2)(R'_3)^+X^-$ wherein $R_f$ is a straight or branched chain perfluoroalkyl group having 4 to 18 carbon atoms, R is a divalent linking group comprising at least 4 carbon atoms and a sulfide group in the chain, $R'_1$, $R'_2$, $R'_3$ are independently hydrogen or alkyl groups or any two of $R'_1$, $R'_2$, and $R'_3$ taken together can represent the carbon and nitrogen atoms necessary to provide a 5- to 7-membered heterocyclic ring with the cationic nitrogen atom, and $X^-$ is a monovalent anion. These antistatic compositions are described in more detail in copending and commonly assigned U.S. Ser. No. 10/265,058 (filed Oct. 4, 2002 by Sakizadeh, LaBelle, and Bhave) that is incorporated herein by reference.

The photothermographic materials of this invention can be constructed of one or more layers on a support. Single layer materials should contain the photocatalyst, the non-photosensitive source of reducible silver ions, the reducing composition, the binder, as well as optional materials such as toners, acutance dyes, coating aids and other adjuvants on the front side of the support. At least one layer is then constructed on the backside to include the backside stabilizer(s) as described above.

Two-layer constructions comprising a single imaging layer coating containing all the ingredients and a surface protective topcoat are generally found in the materials of this invention. However, two-layer constructions containing photocatalyst and non-photosensitive source of reducible silver ions in one imaging layer (usually the layer adjacent to the support) and the reducing composition and other ingredients in the second imaging layer or distributed between both layers are also envisioned.

Layers to promote adhesion of one layer to another in photothermographic materials are also known, as described for example in U.S. Pat. No. 5,891,610 (Bauer et al.), U.S. Pat. No. 5,804,365 (Bauer et al.), and U.S. Pat. No. 4,741,992 (Przezdziecki). Adhesion can also be promoted using specific polymeric adhesive materials as described for example in U.S. Pat. No. 5,928,857 (Geisler et al.).

Layers to reduce emissions from the photothermographic material may also be present, including the polymeric barrier layers described in U.S. Pat. No. 6,352,819 (Kenney et al.), U.S. Pat. No. 6,352,820 (Bauer et al.), U.S. Pat. No. 6,420,102B1 (Bauer et al.), in copending and commonly assigned U.S. Ser. No. 10/341,747 (filed Jan. 14, 2003 by Rao, Hammerschmidt, Bauer, Kress, and Miller), and in copending and commonly assigned U.S. Ser. No. 10/351,814 (filed Jan. 27, 2003 by Hunt), all incorporated herein by reference.

Photothermographic formulations described herein can be coated by various coating procedures including wire wound rod coating, dip coating, air knife coating, curtain coating, slide coating, or extrusion coating using hoppers of the type described in U.S. Pat. No. 2,681,294 (Beguin). Layers can be coated one at a time, or two or more layers can be coated simultaneously by the procedures described in U.S. Pat. No. 2,761,791 (Russell), U.S. Pat. No. 4,001,024 (Dittman et al.), U.S. Pat. No. 4,569,863 (Keopke et al.), U.S. Pat. No. 5,340,613 (Hanzalik et al.), U.S. Pat. No. 5,405,740 (LaBelle), U.S. Pat. No. 5,415,993 (Hanzalik et al.), U.S. Pat. No. 5,525,376 (Leonard), U.S. Pat. No. 5,733,608 (Kessel et al.), U.S. Pat. No. 5,849,363 (lapel et al.), U.S. Pat. No. 5,843,530 (Jerry et al.), U.S. Pat. No. 5,861,195 (Bhave et al.), and GB 837,095 (Ilford). A typical coating gap for the emulsion layer can be from about 10 to about 750 μm, and the layer can be dried in forced air at a temperature of from about 20° C. to about 100° C. It is preferred that the thickness of the layer be selected to provide maximum image densities greater than about 0.2, and more preferably, from about 0.5 to 5.0 or more, as measured by a MacBeth Color Densitometer Model TD 504.

When the layers are coated simultaneously using various coating techniques, a "carrier" layer formulation comprising a single-phase mixture of the two or more polymers described above may be used. Such formulations are described in U.S. Pat. No. 6,355,405 (Ludemann et al.).

Mottle and other surface anomalies can be reduced in the materials of this invention by incorporation of a fluorinated polymer as described for example in U.S. Pat. No. 5,532,121 (Yonkoski et al.) or by using particular drying techniques as described, for example in U.S. Pat. No. 5,621,983 (Ludemann et al.).

Preferably, two or more layers are applied to a film support using slide coating. The first layer can be coated on top of the second layer while the second layer is still wet. The first and second fluids used to coat these layers can be the same or different.

While the first and second layers can be coated on one side of the film support, manufacturing methods can also include forming on the opposing or backside of said polymeric support, one or more additional layers, including an antihalation layer, an antistatic layer, or a layer containing a matting agent (such as silica), an imaging layer, a protective overcoat, or a combination of such layers. At least one of these layers includes the backside stabilizer(s) as described above.

To promote image sharpness, photothermographic materials prepared by the present invention can contain one or more layers containing acutance and/or antihalation dyes. These dyes are chosen to have absorption close to the exposure wavelength and are designed to absorb scattered light. One or more antihalation compositions may be incorporated into one or more antihalation layers according to known techniques, as an antihalation backing layer, as an antihalation underlayer, or as an antihalation overcoat. Additionally, one or more acutance dyes may be incorporated into one or more frontside layers such as the photothermographic emulsion layer, primer layer, underlayer, or topcoat layer on the frontside according to known techniques. It is preferred that the photothermographic materials of this invention contain an antihalation composition on the backside of the support, and more preferably in the backside conductive layer.

An antihalation layer is preferred in the practice of the present invention and is composed of a suitable antihalation composition. Examples of useful antihalation compositions include various dyes and pigments including carbon black as described for example in U.S. Pat. No. 4,312,941 (Scharf et al.), U.S. Pat. No. 4,581,323 (Fisher et al.), U.S. Pat. No. 4,477,562 (Zeller-Pendrey), U.S. Pat. No. 4,581,325 (Kitchin et al.), U.S. Pat. No. 4,839,265 (Ohno et al.), U.S. Pat. No. 5,985,537 (Philip, Jr. et al.), and EP 0 714,046A1 (Parkinson et al.).

Dyes useful as antihalation and acutance dyes include squaraine dyes described in U.S. Pat. No. 5,380,635 (Gomez et al.), U.S. Pat. No. 6,063,560 (Suzuki et al.), and EP 1 083 459A1 (Kimura), the indolenine dyes described in EP 0 342 810A1 (Leichter), and the cyanine dyes described in copending and commonly assigned U.S. Published Application 2003-0162134 (Hunt et al.). All of the above references are incorporated herein by reference.

One particularly useful dihydroperimidine squaraine antihalation dye is cyclobutenediylium, 1,3-bis[2,3-dihydro-2,2-bis[[1-oxohexyl)oxy]methyl]-1H-perimidin-4-yl]-2,4-dihydroxy-, bis(inner salt). One particularly useful cyanine antihalation dye, compound (6) described therein, is 3H-Indolium, 2-[2-[2-chloro-3-[(1,3-dihydro-1,3,3-trimethyl-2H-indol-2-ylidene)ethylidene]-5-methyl-1-cyclohexen-1-yl] ethenyl]-1,3,3-trimethyl-, perchlorate.

Heat-bleachable compositions can be used in backside layers as antihalation compositions. Under practical conditions of use, such compositions are heated to provide bleaching at a temperature of at least 90° C. for at least 0.5 seconds. Preferably, bleaching is carried out at a temperature of from about 100° C. to about 200° C. for from about 5 to about 20 seconds. Most preferred bleaching is carried out within 20 seconds at a temperature of from about 110° C. to about 130° C.

It is also useful in the present invention to employ compositions including acutance or antihalation dyes that will decolorize or bleach with heat during processing. Dyes and constructions employing these types of dyes are described in, for example, U.S. Pat. No. 5,135,842 (Kitchin et al.), U.S. Pat. No. 5,266,452 (Kitchin et al.), U.S. Pat. No. 5,314,795 (Helland et al.), U.S. Pat. No. 6,306,566, (Sakurada et al.), U.S. Published Application 2001-0001704 (Sakurada et al.), JP Kokai 2001-142175 (Hanyu et al.), and JP 2001-183770 (Hanye et al.). Also useful are bleaching compositions described in JP Kokai 11-302550 (Fujiwara), JP Kokai 2001-109101 (Adachi), JP Kokai 2001-51371 (Yabuki et al.), JP Kokai 2001-22027 (Adachi), JP Kokai 2000-029168 (Noro), and U.S. Pat. No. 6,376,163 (Goswami, et al.). All of the above references are incorporated herein by reference.

Particularly, useful heat-bleachable antihalation compositions can include an infrared radiation absorbing compound such as an oxonol dyes and various other compounds used in combination with a hexaarylbiimidazole (also known as a "HABI"), or mixtures thereof. Such HABI compounds are well known in the art, such as U.S. Pat. No. 4,196,002 (Levinson et al.), U.S. Pat. No. 5,652,091 (Perry et al.), and U.S. Pat. No. 5,672,562 (Perry et al.), all incorporated herein by reference. Examples of such heat-bleachable compositions are described for example in U.S. Pat. No. 6,558,880 (Goswami et al.) and U.S. Pat. No. 6,514,677 (Ramsden et al.), both incorporated herein by reference.

In preferred embodiments, the photothermographic materials include a surface protective layer on the same side of the support as the one or more photothermographic emulsion layers and a layer on the backside that includes an antihalation composition and/or conductive antistatic components. A separate backside surface protective layer can also be included in these embodiments.

Imaging/Development

The photothermographic materials of the present invention can be imaged in any suitable manner consistent with the type of material using any suitable imaging source (typically some type of radiation or electronic signal).

In some embodiments, the materials are sensitive to radiation in the range of from about at least 300 nm to about 1400 nm, and preferably from about 300 mm to about 850 nm. Imaging can be achieved by exposing the photothermographic materials of this invention to a suitable source of radiation to which they are sensitive, including ultraviolet radiation, visible light, near infrared radiation and infrared radiation to provide a latent image. Suitable exposure means are well known and include sources of radiation, including: incandescent or fluorescent lamps, xenon flash lamps, lasers, laser diodes, light emitting diodes, infrared lasers, infrared laser diodes, infrared light-emitting diodes, infrared lamps, or any other ultraviolet, visible, or infrared radiation source readily apparent to one skilled in the art, and others described in the art, such as in *Research Disclosure*, September, 1996, item 38957. For strictly near-infrared and infrared sensitive photothermographic materials of the present invention, imaging may be carried out at a wavelength of from about 750 to about 1150 nm. Particularly useful near-infrared and infrared exposure means include laser diodes, including laser diodes that are modulated to increase imaging efficiency using what is known as multi-longitudinal exposure techniques as described in U.S. Pat. No. 5,780,207 (Mohapatra et al.). Other exposure techniques are described in U.S. Pat. No. 5,493,327 (McCallum et al.).

In some embodiments, the photothermographic materials of the present invention can be made sensitive to X-radiation and imaged using any suitable X-radiation imaging source to provide a latent image. Suitable X-radiation imaging sources include general medical, mammographic, dental, industrial X-ray units, and other X-radiation generating equipment known to one skilled in the art.

Thermal development conditions will vary, depending on the construction used but will typically involve heating the imagewise exposed material at a suitably elevated temperature. Thus, the latent image can be developed by heating the exposed material at a moderately elevated temperature of, for example, from about 50° C. to about 250° C. (preferably from about 80° C. to about 200° C. and more preferably from about 100° C. to about 200° C.) for a sufficient period of time, generally from about 1 to about 120 seconds. Heating can be accomplished using any suitable heating means such as a hot plate, a steam iron, a hot roller or a heating bath. A preferred heat development procedure includes heating at from about 110° C. to about 135° C. for from about 3 to about 25 seconds.

In some methods, the development is carried out in two steps. Thermal development takes place at a higher temperature for a shorter time (for example at about 150° C. for up to 10 seconds), followed by thermal diffusion at a lower temperature (for example at about 80° C.) in the presence of a transfer solvent.

In another two-step development method, thermal development can take place using a preheating step (for example at about 110° C. for up to 10 seconds), immediately followed by a final development step (for example at about 125° C. for up to 20 seconds).

Use as a Photomask

The photothermographic materials of the present invention are sufficiently transmissive in the range of from about 350 to about 450 nm in non-imaged areas to allow their use in a method where there is a subsequent exposure of an ultraviolet or short wavelength visible radiation sensitive imageable medium. For example, imaging the photothermographic material and subsequent development affords a visible image. The heat-developed photothermographic material absorbs ultraviolet or short wavelength visible radiation in the areas where there is a visible image and transmits ultraviolet or short wavelength visible radiation where there is no visible image. The heat-developed material may then be used as a mask and positioned between a source of imaging radiation (such as an ultraviolet or short wavelength visible radiation energy source) and an imageable material that is sensitive to such imaging radiation, such as a photopolymer, diazo material, photoresist, or photosensitive printing plate. Exposing the imageable material to the imaging radiation through the visible image in the exposed and heat-developed photothermographic material provides an image in the imageable material. This method is particularly useful where the imageable medium comprises a printing plate and the photothermographic material serves as an imagesetting film.

Thus, in one embodiment, the present invention provides a method comprising:

A) imagewise exposing a photothermographic material of the present invention to electromagnetic radiation to form a latent image, and B) simultaneously or sequentially, heating the exposed photothermographic material to develop the latent image into a visible image.

Where the photothermographic material comprises a transparent support, the visible image prepared from a photothermographic material can also be used as a mask for exposure of other photosensitive imageable materials, such as graphic arts films, proofing films, printing plates and circuit board films, that are sensitive to suitable imaging radiation (for example, UV radiation). This can be done by imaging an imageable material (such as a photopolymer, a diazo material, a photoresist, or a photosensitive printing plate) through the heat-developed photothermographic material.

Where the photothermographic material comprises a transparent support, this image-forming method can further comprise:

C) positioning the exposed and heat-developed photothermographic material with the visible image therein between a source of imaging radiation and an imageable material that is sensitive to the imaging radiation, and D) exposing the imageable material to the imaging radiation through the visible image in the exposed and heat-developed photothermographic material to provide an image in the imageable material.

Phosphors

In some embodiments, it is also effective to incorporate X-radiation-sensitive phosphors within the imaging layers containing the photosensitive silver halide to increase photospeed. Organic solvent-based emulsions and materials are described in U.S. Pat. No. 6,440,649B1 (Simpson et al.), aqueous-based emulsions and materials are described in U.S. Pat. No. 6,573,033 (Simpson et al.), both of which are incorporated herein by reference.

Phosphors are materials that emit infrared, visible, or ultraviolet radiation upon excitation. An intrinsic phosphor is a material that is naturally (that is, intrinsically) phosphorescent. An "activated" phosphor is one composed of a basic material that may or may not be an intrinsic phosphor, to which one or more dopant(s) has been intentionally added. These dopants "activate" the phosphor and cause it to emit infrared, visible, or ultraviolet radiation. For example, in $Gd_2O_2S$:Tb, the Tb atoms (the dopant/activator) give rise to the optical emission of the phosphor.

Some phosphors, such as BaFBr, are known as storage phosphors. In these materials, the dopants are involved in the storage as well as the emission of radiation. When storage phosphors are incorporated within the photothermographic materials, the initial exposure to X-radiation is "stored" within the phosphor particles. When the material is then later exposed a second time to stimulating electromagnetic radiation (usually to visible light or infrared radiation), the "stored" energy is then released as an emission of visible or infrared radiation. The photothermographic materials may then be developed by heating. BaFBr described herein is such a storage phosphor.

Any conventional or useful phosphor can be used, singly or in mixtures, in the practice of this invention. More specific details of useful phosphors are provided as follows.

For example, useful phosphors are described in numerous references relating to fluorescent intensifying screens, including but not limited to, *Research Disclosure*, Vol. 184, August 1979, Item 18431, Section IX, X-ray Screens/Phosphors, and U.S. Pat. No. 2,303,942 (Wynd et al.), U.S. Pat. No. 3,778,615 (Luckey), U.S. Pat. No. 4,032,471 (Luckey), U.S. Pat. No. 4,225,653 (Brixner et al.), U.S. Pat. No. 3,418,246 (Royce), U.S. Pat. No. 3,428,247 (Yocon), U.S. Pat. No. 3,725,704 (Buchanan et al.), U.S. Pat. No. 2,725,704 (Swindells), U.S. Pat. No. 3,617,743 (Rabatin), U.S. Pat. No. 3,974,389 (Ferri et al.), U.S. Pat. No. 3,591,516 (Rabatin), U.S. Pat. No. 3,607,770 (Rabatin), U.S. Pat. No. 3,666,676 (Rabatin), U.S. Pat. No. 3,795,814 (Rabatin), U.S. Pat. No. 4,405,691 (Yale), U.S. Pat. No. 4,311,487 (Luckey et al.), U.S. Pat. No. 4,387,141 (Patten), U.S. Pat. No. 5,021,327 (Bunch et al.), U.S. Pat. No. 4,865,944 (Roberts et al.), U.S. Pat. No. 4,994,355 (Dickerson et al.), U.S. Pat. No. 4,997,750 (Dickerson et al.), U.S. Pat. No. 5,064,729 (Zegarski), U.S. Pat. No. 5,108,881 (Dickerson et al.), U.S. Pat. No. 5,250,366 (Nakajima et al.), U.S. Pat. No. 5,871,892 (Dickerson et al.), EP 0 491,116A1 (Benzo et al.), the disclosures of all of which are incorporated herein by reference with respect to the phosphors.

Useful phosphors include, but are not limited to, calcium tungstate ($CaWO_4$), activated or unactivated lithium stannates, niobium and/or rare earth activated or unactivated yttrium, lutetium, or gadolinium tantalates, rare earth (such as terbium, lanthanum, gadolinium, cerium, and lutetium)-activated or unactivated middle chalcogen phosphors such as rare earth oxychalcogenides and oxyhalides, and terbium-activated or unactivated lanthanum and lutetium middle chalcogen phosphors.

Still other useful phosphors are those containing hafnium as described for example in U.S. Pat. No. 4,988,880 (Bryan et al.), U.S. Pat. No. 4,988,881 (Bryan et al.), U.S. Pat. No. 4,994,205 (Bryan et al.), U.S. Pat. No. 5,095,218 (Bryan et al.), U.S. Pat. No. 5,112,700 (Lambert et al.), U.S. Pat. No. 5,124,072 (Dole et al.), and U.S. Pat. No. 5,336,893 (Smith et al.), the disclosures of which are all incorporated herein by reference.

Imaging Assemblies

To further increase photospeed, the photothermographic materials of this invention may be used in association with one or more phosphor intensifying screens and/or metal screens in what is known as "imaging assemblies." An intensifying screen absorbs X-radiation and emits longer wavelength electromagnetic radiation that the photosensitive silver halide more readily absorbs. Double-coated photothermographic materials (that is, materials having one or more thermally developable imaging layers on both sides of the support) are preferably used in combination with two intensifying screens, one screen in the "front" and one screen in the "back" of the material.

The imaging assemblies are composed of a photothermographic material as defined herein (particularly one sensitive to X-radiation or visible light) and one or more phosphor intensifying screens adjacent the front and/or back of the material. The screens are typically designed to absorb X-rays and to emit electromagnetic radiation having a wavelength greater than 300 nm.

There are a wide variety of phosphors known in the art that can be formulated into phosphor intensifying screens, including but not limited to, the phosphors described in *Research Disclosure*, Vol. 184, August 1979, item 18431, Section IX, X-ray Screens/Phosphors, (noted above), hafnium containing phosphors (noted above), as well as those described in U.S. Pat. No. 4,835,397 (Arakawa et al.), U.S. Pat. No. 5,381,015 (Dooms), U.S. Pat. No. 5,464,568 (Bringley et al.), U.S. Pat. No. 4,226,653 (Brixner), U.S. Pat. No. 5,064,729 (Zegarski), U.S. Pat. No. 5,250,366 (Nakajima et al.), and U.S. Pat. No. 5,626,957 (Benso et al.), U.S. Pat. No. 4,368,390 (Takahashi et al.), U.S. Pat. No. 5,227,253 (Takasu et al.), the disclosures of which are all incorporated herein by reference for their teaching of phosphors and formulation of phosphor intensifying screens.

Phosphor intensifying screens can take any convenient form providing they meet all of the usual requirements for use in radiographic imaging, as described for example in U.S. Pat. No. 5,021,327 (Bunch et al.), incorporated herein by reference. A variety of such screens are commercially available from several sources including but not limited to, LANEX®, X-SIGHT® and InSight® Skeletal screens all available from Eastman Kodak Company. The front and back screens can be appropriately chosen depending upon the type of emissions desired, the desired photicity, emulsion speeds, and % crossover. A metal (such as copper or lead) screen can also be included if desired.

Imaging assemblies can be prepared by arranging a suitable photothermographic material in association with one or more phosphor intensifying screens, and one or more metal screens in a suitable holder (often known as a cassette), and appropriately packaging them for transport and imaging uses.

Constructions and assemblies useful in industrial radiography include, for example, U.S. Pat. No. 4,480,024 (Lyons et al), U.S. Pat. No. 5,900,357 (Feumi-Jantou et al.), and EP 1 350 883 A1 (Pesce et al.).

Materials and Methods for the Examples:

All materials used in the following examples are readily available from standard commercial sources, such as Aldrich Chemical Co. (Milwaukee Wis.) unless otherwise specified. All percentages are by weight unless otherwise indicated. The following additional terms and materials were used.

DRYVIEW® Medical Imaging Film is available from Eastman Kodak Company (Rochester, N.Y.).

ACRYLOID A-21 is an acrylic copolymer that is available from Rohm and Haas (Philadelphia, Pa.).

PIOLOFORM BL-16 and PIOLOFORM BS-18 are polyvinyl butyral resin that is available from Wacker Polymer Systems (Adrian, Mich.).

CAB 171-15S and CAB 381-20 are cellulose acetate butyrate resins that are available from Eastman Chemical Co (Kingsport, Tenn.).

CCBA is 4-chlorobenzoyl benzoic acid

CELNAX® CX-Z401M is a 40% organosol dispersion of non-acicular zinc antimonate particles in methanol. It was obtained from Nissan Chemical America Corporation (Houston, Tex.).

DESMODUR® N 3300 is an aliphatic hexamethylene diisocyanate that is available from Bayer Chemicals (Pittsburgh, Pa.).

LOWINOX 221B446 is 2,2-isobutylidene-bis-(4,6-dimethylphenol) that is available from Great Lakes Chemical (West Lafayette, Ind.).

MEK is methyl ethyl ketone (or 2-butanone).

MeOH is methanol ($CH_3OH$).

MMBI is 5-methyl-2-mercaptobenzimidazole.

4-MPA is 4-methylphthalic acid.

PIOLOFORM® LL 4140 a polyvinyl butyral resin available from Wacker Polymer Systems (Adrian, Mich.).

SYLOID 74×6000 is synthetic amorphous silica that is available from Grace-Davison.

SYLSIA 310P is synthetic amorphous silica that is available from Fuji Silysia.

VITEL PE 2200 VITEL PE 5833 B are polyester resins available from Bostik, Inc. (Middleton, Mass.).

ZONYL® FSD is a cationic fluorosurfactant from DuPont (Wilmington, Del.). It is believed to have the following structure as disclosed in U.S. Pat. No. 5,442,011 (Halling)

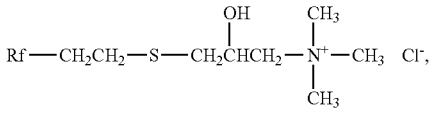

where $R_f$ is $CF_3CF_2(CF_2CF_2)_z$ and z is 2 to 4.

Vinyl Sulfone-1 (VS-1) is described in U.S. Pat. No. 6,143,487 and has the following structure:

(VS-1)

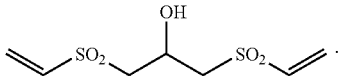

Antifoggant A (AF-A) is 2-(Tribromomethylsulfonyl)pyridine and has the following structure:

(AF-A)

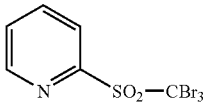

Antifoggant B (AF-B) is described in U.S. Pat. No. 5,686,228 and has the following structure:

(AF-B)

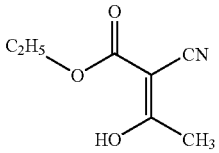

Backcoat Dye BC-1 is cyclobutenediylium, 1,3-bis[2,3-dihydro-2,2-bis[[1-oxohexyl)oxy]methyl]-1H-perimidin-4-yl]-2,4-dihydroxy-, bis(inner salt). It is believed to have the structure shown below.

BC-1

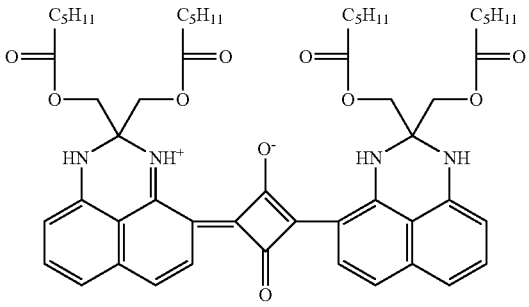

Spectral sensitizing Dye A ($X^-$ is iodide) has the following structure:

SSD-A

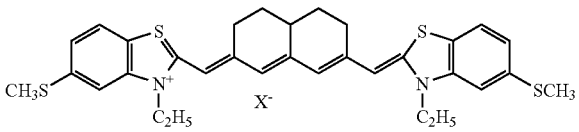

Acutance Dye AD-1 has the following structure:

AD-1

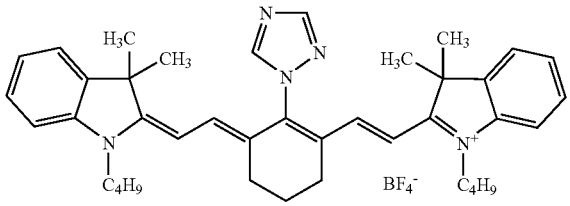

Tinting Dye TD-1 has the following structure:

TD-1

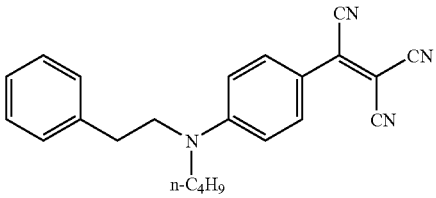

Organic Sulfur Containing Compound OSC-1 has the following structure:

OSC-1

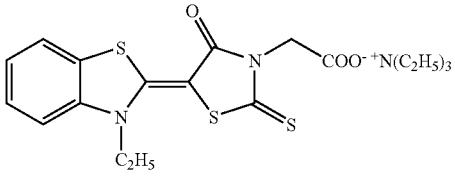

Absorbance was measured on a conventional visible spectrophotometer at the given wavelength in optical density units.

The following examples are intended to illustrate the practice of the present invention and not to limit the scope of the invention in any manner.

Backside Coating Samples 1–10:

Backside stabilizer formulations containing different amounts of backside stabilizers were prepared and coated onto a support. These coating samples did not contain any photothermographic coatings on the front side, but they were used to demonstrate the advantages of using the backside stabilizers. Thus, the results obtained from these coating samples can be correlated to the results that would be obtained if they were on the backside of photothermographic materials of this invention.

Backside Premix Formulation:

A master batch of backside formulation was prepared by mixing the following ingredients:

| | |
|---|---|
| CAB 381-20 | 249.21 g |
| MEK | 1695.51 g |
| VITEL PE-2200 | 3.54 g |
| Syloid Premix | 103.65 g |

Syloid Premix Formulation:

A master batch of Syloid premix formulation was prepared by mixing the following ingredients:

| | |
|---|---|
| MEK | 186 g |
| CAB 381-20 | 7.64 g |
| Syloid 74 × 6000 | 6.36 g |

Backside Coating Formulation:

| | |
|---|---|
| Backside Premix Formulation | 17.0 g |
| Amine Compound | amount indicated in 5.1 g of MEK |

Backside stabilizer formulations were prepared by mixing a solution of 0.33 mmol of backside stabilizers with 5.1 g of MEK into 17.0 g of backside premix formulation. Backside stabilizers AB-1 to AB-10 were used. This is referred to herein as the "1X" relative concentration of the backside stabilizers. Backside stabilizer coating formulations were also prepared containing 25% and 150% of the compounds. These coating formulations are identified herein as "0.25X" and "1.5X" relative concentrations.

Each of the formulations was coated onto a 7 mil (178 μm) blue-tinted polyethylene terephthalate film support using a knife coater to obtain a dry coating weight of about 0.4 g/ft$^2$ (0.037 g/m$^2$). Immediately after coating, the samples were dried in a forced air oven at 84° C. for between 3 and 5 minutes. Samples were cut in to 10 inch×1.25 inch (254 mm×32 mm) strips.

The effect of the backside stabilizer compounds on the shelf stability of the photothermographic materials was evaluated by stacking these strips with their backside coating in contact with the emulsion side (frontside) of similarly prepared strips of commercially available Kodak DRYVIEW® Medical Imaging Film.

Comparative samples were also prepared and evaluated by stacking coated samples containing a backside coating formulation (prepared as above, but with the amine compound omitted) in contact with the emulsion side (frontside) of samples of commercially available Kodak DRYVIEW® Medical Imaging Film. Strips of DRYVIEW® Film were also imaged to provide initial sensitometric data.

The stacked samples and films were bagged tightly in a high-density, flat-black polyethylene bag and allowed to "age" for 2 to 3 months. Some samples were aged at 70° F. (21° C.) at 95–100% relative humidity. Other samples were aged at 80° F. (27° C.) at 80% relative humidity.

The photothermographic materials were then imagewise exposed using a laser sensitometer and heat-developed in a conventional DRYVIEW® Model 2771 processor at 122.5° C. for 15 seconds to provide continuous tone wedges with optical densities varying from $D_{min}$ to an optical density greater than 3.5. Each imaged film was then scanned with a densitometer that takes an optical density reading every 0.33 mm. The resulting data were used to calculate initial $D_{min}$, contrast ("AC-1"), and photospeed ("SPD-3"). Changes (Δ) in $D_{min}$, "AC-1," and ("SPD-3") were calculated relative to the changes (Δ) in $D_{min}$, "AC-1," and ("SPD-3") for the comparative sample.

The data shown below in TABLE I demonstrate that certain amine compounds, when placed in a backside coating in contact with the frontside of a photothermographic material, decrease the change in $D_{min}$ upon storage at high humidity and thus provide improved control of shelf-aging fog with little or no loss in contrast and or photospeed retention. TABLE I also includes vapor pressure (VP) and pKa values for the various backside stabilizers. The predicted values of VP were determined using ACD/I-Lab Web Service (ACD/Boiling Point and Vapor Pressure, Version 7.02), and the predicted values of pKa were determined using ACD/I-Lab Web Service (ACD/pKa Version 7.02). Both are available from Advanced Chemistry Development, Inc., (ADC) Toronto ON, Canada, www.acdlabs.com, 2003. The pH for each compound was obtained for a 0.005 molar solution of the compound in a mixture of 15% methanol/85% water.

Backside Coating Formulation:

| | |
|---|---|
| Backside Premix Formulation | 17.0 g |
| Amine Compound | amount indicated in 5.1 g of MEK |

Commercially available Kodak DRYVIEW® Medical Imaging Film was aged against these coatings in the same manner described for backside coatings 1–10. The results, shown below in TABLE II, demonstrate that certain amine compounds, when placed in an antihalation, antistatic backside coating in contact with the frontside of a photothermographic material, decrease the change in $D_{min}$ upon storage at high humidity and thus provide improved control of shelf-aging fog with little change in contrast and photospeed.

TABLE I

| Sample | Compound | VP (torr) | pKa | pH | Level | Conditions | Δ Dmin | Δ AC-1 | Δ SPD-3 |
|---|---|---|---|---|---|---|---|---|---|
| 1 | AB-1 | 4.05 | 9.9 | 10.4 | 1 | 70° F. (21° C.) at 95% RH | −70% | 0.27 | 0.004 |
| 2 | AB-2 | 1.23 | 8.19 | 9.8 | 1 | 70° F. (21° C.) at 95% RH | −60% | 0.17 | 0.001 |
| 3 | AB-3 | 2.09 | 15.2 | 11.8 | 1 | 70° F. (21° C.) at 95% RH | −80% | 0.30 | −0.018 |
| 4 | AB-4 | 0.043 | 13.4 | 11.7 | 0.25 | 70° F. (21° C.) at 95% RH | −60% | 0.32 | 0.003 |
| 5 | AB-5 | $8.4 \times 10^{-6}$ | 7.77 | 9.1 | 1 | 70° F. (21° C.) at 95% RH | −30% | 0.06 | −0.021 |
| 6 | AB-6 | 0.00183 | 13.55 | 11.8 | 0.25 | 70° F. (21° C.) at 95% RH | −60% | 0.28 | −0.007 |
| 7 | AB-7 | $6.9 \times 10^{-5}$ | 3.99 | 8.5 | 1.5 | 80° F. (27° C.) at 80% RH | −50% | 0.21 | −0.014 |
| 8 | AB-8 | 0.0003 | 10.12 | 10.6 | 1 | 70° F. (21° C.) at 95% RH | −80% | 0.43 | −0.011 |
| 9 | AB-9 | $3.9 \times 10^{-6}$ | 6.9 | 8.6 | 1.5 | 80° F. (27° C.) at 80% RH | −30% | 0.31 | 0.007 |
| 10 | AB-10 | $1.8 \times 10^{-5}$ | 10.1 | | 1.5 | 80° F. (27° C.) at 80% RH | −40% | −0.38 | 0.042 |

Backside Coating Samples 11–12:

Backside formulations containing an antihalation dye, an antistatic agent and an amine backside stabilizer were prepared and coated on the backside of a support. The procedures for mixing and coating are the same as that for Coating Samples 1–10.

TABLE II

| Sample | Compound | VP (torr) | pKa | pH | Level | Conditions | Δ Dmin | Δ AC-1 | Δ SPD-3 |
|---|---|---|---|---|---|---|---|---|---|
| 11 | AB-6 | 0.0054 | 12.8 | 11.8 | 0.5 | 70° F. (21° C.) at 95% RH | −70% | 0.31 | −0.03 |
| 12 | AB-4 | 0.0003 | 10.4 | 11.7 | 0.5 | 70° F. (21° C.) at 95% RH | −60% | 0.24 | −0.03 |

Backside Premix Formulation:

A master batch of backside formulation was prepared by mixing the following ingredients:

| | |
|---|---|
| CAB 381-20 | 700 g |
| MEK | 391.5 g |
| MeOH | 182.6 g |
| VITEL PE-2200 | 1.19 g |
| BC-1 Dye | 0.52 g |
| ZONYL ® FSD | 5.26 |
| Syloid Premix | 34.8 g |

Syloid Premix Formulation: (Same as Coating Samples 1–10 above)

Backside Coating Sample 13:

The following sample demonstrates a construction in which the amine and antihalation dye are coated in one layer, and the antistatic agent is coated in another layer.

Backside coating formulations containing an antihalation dye, an antistatic agent, and an amine backside stabilizer were prepared for coating on the backside of a support. The coating formulation contained antihalation dye (AD-1) and Syloid 74×6000. The antistatic coating formulation contained CELNAX® CX-Z401M and amine compound AB-8.

Antihalation Coating Formulation:

| | |
|---|---|
| MEK | 266.4 g |
| CAB381-20 | 32.94 g |
| BC-1 Dye | 0.213 g |
| Syloid 74X6000 | 0.42 g |

Antistatic Coating Formulation:

| | |
|---|---|
| CELNAX ® CX-Z401M | 7.04 g |
| MEK | 15.0 g |
| CAB 381-20/PE 2700 B (4:1). | 77.97 g of 5.97% solution in MEK |
| Compound AB-8 | 0.50 g |

The antistatic and antihalation coating formulations were simultaneously coated onto a 7 mil (178 μm) blue-tinted polyethylene terephthalate film support using an automated dual knife coater. The antihalation coating was coated above the antistatic coating. The coating gap for the antistatic layer was 8 mil (203 μm), [that is, 1 mil (25.4 μm) above the substrate]. The coating gap for the antihalation coating was 10.5 mil (254 μm), [that is, 3.5 mil (76 μm) above the substrate]. Immediately after coating, the samples were dried in a forced air oven at 97° C. for 2.5 minutes.

EXAMPLE 14

Photothermographic Material

Photothermographic materials of the present invention were prepared in the following manner in which an amine backside stabilizer was coated on the backside of a support.

Backside Premix Formulation:

A master batch of backside formulation was prepared by mixing the following ingredients:

| | |
|---|---|
| CAB 381-20 | 272.1 g |
| MEK | 1614.7 g |
| Syloid Premix | 113.2 g |

Syloid Premix Formulation: (Same as Coating Samples 1–10 above)

Backside Coating Formulation:

| | |
|---|---|
| Backside Premix Formulation | 15.71 g |
| Amine Compound | amount indicated in 6.3 g of MEK |

A photothermographic solution was slide coated onto the front side with a carrier layer and a protective topcoat.

Photothermographic Emulsion Formulation:

A preformed silver halide, silver carboxylate soap dispersion prepared as described in U.S. Pat. No. 5,939,249 (noted above), was homogenized to 27.2% solids in MEK containing PIOLOFORM BM-18 polyvinyl butyral binder (2%).

479 Parts of the homogenized silver carboxylate soap dispersion prepared above was heated to 22.8° C. 15.6 Parts of a 0.33% solution of OSC-1 in a 5:1 mixture of MEK and MeOH was added. After 30 minutes of mixing, 5.6 parts of an 11% zinc bromide solution in methanol was added. After 30 minutes of mixing, 4.2 parts of a 15% solution of pyridinium hydrobromide perbromide in methanol was added. After 45 minutes of mixing, an addition was made of a solution of 0.4 parts 2-mercapto-5-methylbenzimidazole, 0.019 parts Sensitizing dye SSD-A, 4.4 parts of 2-(4-chlorobenzoyl)benzoic acid, 28.7 parts of methanol, and 10.9 parts of MEK. After stirring for 45 minutes, the temperature was lowered to 10° C. After stirring for another 35 minutes, 52.8 parts of PIOLOFORM® BL-16, 69.6 parts of PIOLOFORM® BM-18 and 3.5 parts MEK was gradually added over a 15 minute period. After 15 minutes of additional mixing, a mixture of 3.1 parts BSP, 0.98 parts TCPA, 1.59 parts 4 MPA, 43.7 parts MEK and 0.82 parts MeOH was added.

The emulsion was completed by mixing for 5 minutes between additions of the following components to each batch:

| | |
|---|---|
| LOWINOX ® 221B446 | 25.2 parts |
| DESMODUR ® N3300 | 1.8 parts, in 1.7 parts MEK |
| Phthalazine | 3.5 parts in 19 parts MEK |

Protective Topcoat Formulation:

A protective topcoat for the photothermographic formulation was prepared by mixing the following ingredients:

| | |
|---|---|
| ACRYLOID ® A-21 | 2.3 parts |
| CAB 171-15S | 25.2 parts |
| MEK | 178.9 parts |
| Vinyl sulfone VS-1 | 0.96 parts |
| Benzotriazole | 0.36 parts |
| Antifoggant B | 0.63 parts |
| SYLISIA ® 310 | 0.56 parts |
| AD-1 dye | 0.4 parts |
| TD-1 dye | 0.017 parts |

Frontside Carrier Formulation:

A frontside carrier formulation was prepared by mixing the following ingredients:

| | |
|---|---|
| VITEL ® PE 5833 B | 7.65 parts |
| PIOLOFORM ® LL 4140 | 17.9 parts |
| MEK | 187 parts |

The frontside carrier, imaging, and topcoat formulations were coated simultaneously onto a 178 μm polyethylene terephthalate film using a slide coater. The silver containing solution was coated to obtain a dry coating weight of about 2 g of silver/$m^2$. The topcoat solution was coated to obtain a dry coating weight of about 0.2 g/$ft^2$ (2.2 g/$m^2$). The frontside carrier solution was coated to obtain a dry coating weight of about 0.03 g/$ft^2$ (0.32 g/$m^2$).

Photothermographic materials with amine compounds (inventive) and without amine compounds (comparative) in the backside prepared in the manner outlined above were aged in a 70° F./80% RH environment. Aging samples from each coating were stacked separately with the front side of one sample against the backside of the next. The samples were bagged tightly in a high-density, flat-black polyethylene bag and placed in a 70° F./80% RH room for 3 months.

The results below in TABLE III, demonstrate that certain amine compounds, when coated onto the backside of a photothermographic material, decrease the change in $D_{min}$ upon storage at high humidity and thus provide improved control of shelf-aging fog with little change in contrast and photospeed.

TABLE III

| Example | Compound | VP (torr) | pKa | pH | Level | Conditions | Δ Dmin | Δ AC-1 | Δ SPD-3 |
|---|---|---|---|---|---|---|---|---|---|
| 1-1 | AB-6 | 0.0054 | 12.8 | 11.8 | 0.5 | 70° F. (21° C.) at 80% RH | −80% | 0.59 | Improved |
| 1-2 | AB-8 | 0.0003 | 10.4 | 10.6 | 0.5 | 70° F. (21° C.) at 80% RH | −90% | 0.98 | Improved |

The invention has been described in detail with particular reference to certain preferred embodiments thereof, but it will be understood that variations and modifications can be effected within the spirit and scope of the invention.

We claim:

1. A photothermographic film pack or stack comprising a plurality of photothermographic materials, each photothermographic material comprising a support having on a frontside thereof, one or more thermally-developable imaging layers comprising a binder and in reactive association, a photosensitive silver halide, a non-photosensitive source of reducible silver ions, and a reducing composition for said non-photosensitive source reducible silver ions, and on a non-photosensitive backside of said support, a backside layer comprising a binder and an amine organic base as a backside stabilizer, the conjugate acid of said organic base having a pKa greater than 5 and being present in an amount of at least 0.01 mmol/$m^2$, wherein said backside stabilizer is represented by the following Structure I:

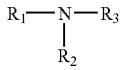

(I)

wherein $R_1$, $R_2$, and $R_3$ are independently chosen from hydrogen, —C($R_4$)═N$R_5$, —C(N$R_6R_7$)═N$R_5$, substituted or unsubstituted alkyl groups having 1 to 18 carbon atoms, substituted or unsubstituted cycloalkyl groups, substituted or unsubstituted alkenyl groups having 2 to 18 carbon atoms, substituted or unsubstituted carbocyclic aryl groups having 6 or 10 carbon atoms in the aromatic rings, substituted or unsubstituted heterocyclic groups having 5 to 10 carbon, nitrogen, sulfur, and oxygen atoms, and $R_4$, $R_5$, $R_6$, and $R_7$ are independently chosen from the same groups as $R_1$, $R_2$, and $R_3$, or any one or more of $R_1$, $R_2$, $R_3$, $R_4$, $R_5$, $R_6$, and $R_7$ as defined above may be joined with each other and/or the central nitrogen atom to complete one or more substituted or unsubstituted heterocyclic ring(s).

2. The photothermographic material of claim 1 wherein said non-photosensitive source of reducible silver ions is a silver fatty acid carboxylate having 10 to 30 carbon atoms in the fatty acid or a mixture of said silver carboxylates.

3. The photothermographic material of claim 1 wherein said reducing composition comprises at least one hindered phenol.

4. The photothermographic material of claim 3 further comprising a high contrast co-developing agent.

5. The photothermographic material of claim 1 that is sensitive to radiation having a wavelength greater than 750 nm.

6. The photothermographic material of claim 1 wherein said backside layer is an antihalation layer further comprising an antihalation composition.

7. The photothermographic material of claim 6 comprising an antihalation composition that comprises an antihalation dye in a separate backside layer.

8. The photothermographic material of claim 1 wherein said backside stabilizer is present in said backside layer in an amount of from about 0.1 to about 10 mmol/$m^2$.

9. The photothermographic material of claim 1 wherein said backside stabilizer is present in said backside layer in an amount of from about 0.05 to about 2 mmol/$m^2$.

10. The photothermographic material of claim 1 wherein said backside stabilizer compound exhibits a vapor pressure of less than 8 torr at a temperature of 25° C.

11. The photothermographic material of claim 1 wherein said backside stabilizer provides a pH of at least 8 when dissolved at 0.005 mol/l in an aqueous solution containing 15% (v/v) of methanol.

12. The photothermographic material of claim 1 wherein $R_1$, $R_2$, and $R_3$ are independently alkyl, —C($R_4$)═N$R_5$, or —C(N$R_6R_7$)═N$R_5$ groups, or any one or more of $R_1$, $R_2$, $R_3$, $R_4$, $R_5$, $R_6$, and $R_7$ may be joined with each other and/or the central nitrogen atom to complete one or more substituted or unsubstituted heterocyclic ring(s).

13. The photothermographic material of claim 1 wherein said backside stabilizers include one or more of the following compounds (AB-1) to (AB-24):

(AB-1)

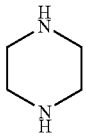

(AB-2)

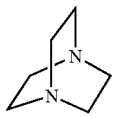

(AB-3)

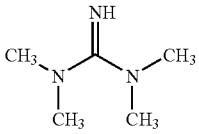

(AB-4)

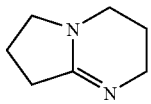

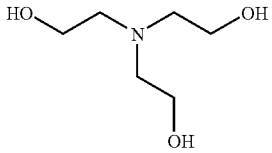
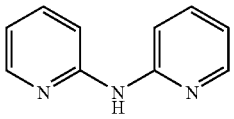
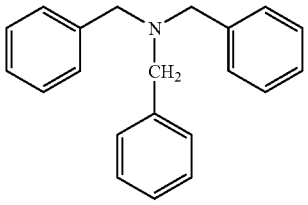
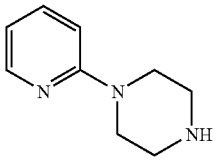
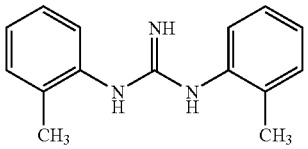
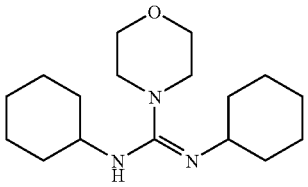
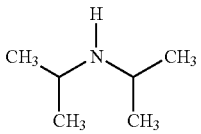
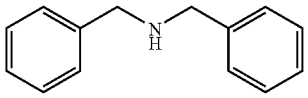
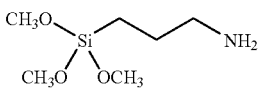
-continued
(AB-5)
(AB-6)
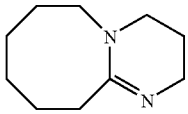
(AB-7)
(AB-8)
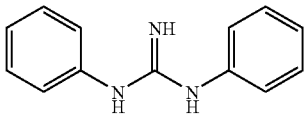
(AB-9)
(AB-10)
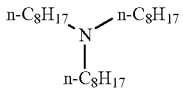
(AB-11)
(AB-12)
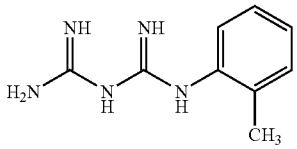
(AB-13)
(AB-14)
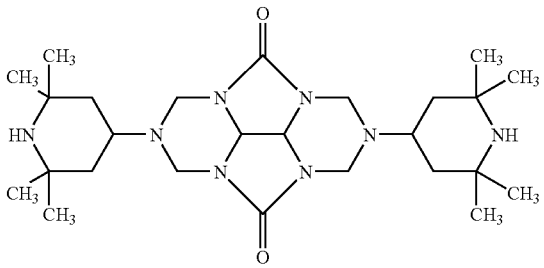
(AB-15)
(AB-16)
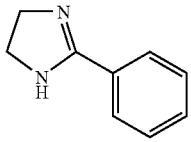
(AB-17)
(AB-18)
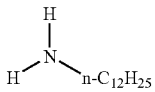
(AB-19)
(AB-20)
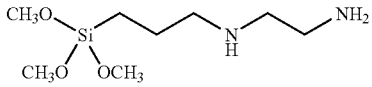
(AB-21)
(AB-22)
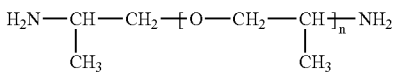
where n is between 5 and 6.

-continued (AB-23)

$$H_2N-\underset{\underset{CH_3}{|}}{CH}-CH_2-[O-\underset{\underset{CH_3}{|}}{CH}-CH_2]_a-[O-CH_2-CH_2]_b-[O-CH_2-\underset{\underset{CH_3}{|}}{CH}-]_c-NH_2$$

where a +c is 3.6 and b is 9

(AB-24)

$$H_2N-\underset{\underset{CH_3}{|}}{CH}-CH_2-[O-\underset{\underset{CH_3}{|}}{CH}-CH_2]_a-[O-CH_2-CH_2]_b-[O-CH_2-\underset{\underset{CH_3}{|}}{CH}-]_c-NH_2.$$

where a +c is 6 and b is 12.5

14. The photothermographic material of claim 1 wherein said binder comprises a water-dispersible polymer latex or a hydrophobic binder.

15. The photothermographic material of claim 1 wherein said backside layer is the sole layer on said non-photosensitive backside.

16. The photothermographic material of claim 1 wherein said backside layer comprises a cellulose acetate binder.

17. The photothermographic material of claim 1 wherein said non-photosensitive backside also comprises a conductive or an antistatic material in one or more backside layers.

18. The photothermographic material of claim 17 wherein said conductive or an antistatic material is non-acicular zinc antimonate particles.

19. The photothermographic material of claim 1 wherein the conjugate acid of said organic amine has a pKa greater than 7.

20. A photographic film pack or stack comprising a plurality of photothermographic materials, each photothermographic material comprising transparent polymer support having on a frontside thereof:

a) one or more thermally-developable imaging layers comprising a hydrophobic binder and in reactive association:

a photosensitive silver bromide, silver iodobromide, or a mixture thereof, a non-photosensitive source of reducible silver ions that comprises one or more silver carboxylates at least one of which is silver behenate, and a reducing composition for said non-photosensitive source reducible silver ions, and b) on a non-photosensitive backside of said support, an antihalation layer comprising an antihalation composition, an antistatic material, and a backside stabilizer that is one or more of the following Compounds (AB-1) through (AB-24), said backside stabilizer being present in an amount of from about 0.05 to about 2 mmol/$m^2$, (AB-1)

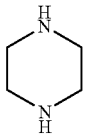

(AB-2)

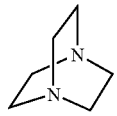

(AB-3)

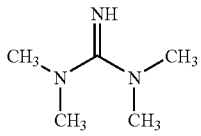

(AB-4)

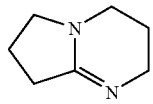

(AB-5)

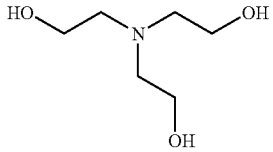

(AB-6)

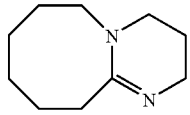

(AB-7)

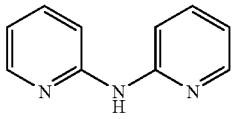

(AB-8)

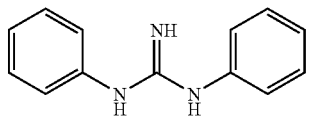

-continued
(AB-9)
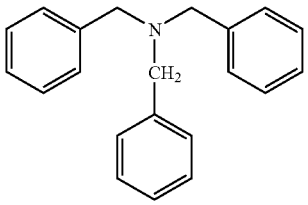
(AB-10)
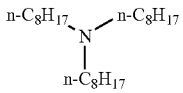
(AB-11)
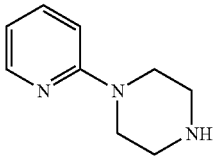
(AB-12)
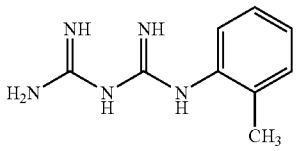
(AB-13)
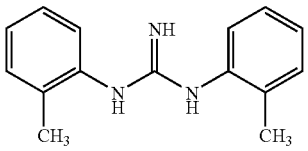
(AB-14)
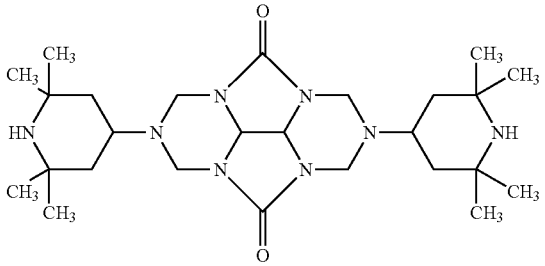
(AB-15)
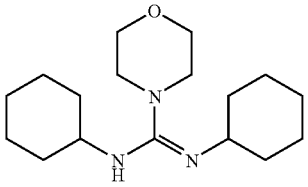
(AB-16)
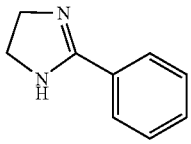
(AB-17)
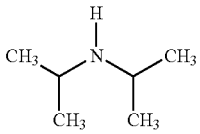
(AB-18)
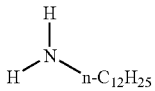
(AB-19)
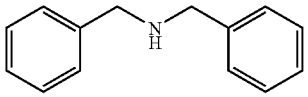
(AB-20)
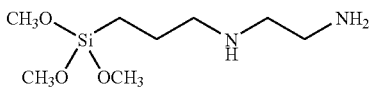
(AB-21)
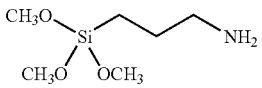
(AB-22)
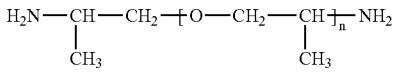
where n is between 5 and 6.
(AB-23)
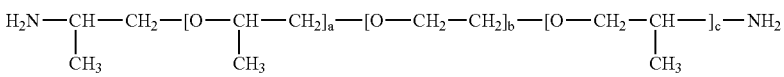
where a +c is 3.6 and b is 9

-continued
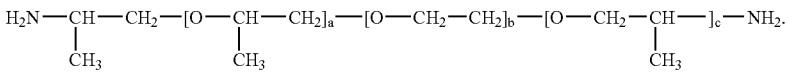
(AB-24)
where a +c is 6 and b is 12.5
21. The photothermographic material of claim 20 further comprising a protective overcoat disposed over said one or more thermally-developable imaging layers, or a conductive material in one or more layers on said non-photosensitive backside, or both.
* * * * *